US009682300B2

(12) United States Patent
Connors

(10) Patent No.: US 9,682,300 B2
(45) Date of Patent: Jun. 20, 2017

(54) SPORTS PRACTICING SYSTEM AND METHOD

(71) Applicant: Robert W. Connors, Lake Barrington, IL (US)

(72) Inventor: Robert W. Connors, Lake Barrington, IL (US)

( * ) Notice: Subject to any disclaimer, the term of this patent is extended or adjusted under 35 U.S.C. 154(b) by 124 days.

(21) Appl. No.: 13/715,570

(22) Filed: Dec. 14, 2012

(65) Prior Publication Data

US 2013/0157785 A1 Jun. 20, 2013

Related U.S. Application Data

(60) Provisional application No. 61/660,480, filed on Jun. 15, 2012, provisional application No. 61/576,643, filed on Dec. 16, 2011.

(51) Int. Cl.

| | |
|---|---|
| ***A63B 69/00*** | (2006.01) |
| *A63B 69/36* | (2006.01) |
| *A63B 69/38* | (2006.01) |
| *A63B 71/02* | (2006.01) |
| *A63B 71/00* | (2006.01) |
| *A63B 71/06* | (2006.01) |

(52) U.S. Cl.

CPC ..... *A63B 69/0002* (2013.01); *A63B 69/0079* (2013.01); *A63B 69/0091* (2013.01); *A63B 69/0013* (2013.01); *A63B 69/3655* (2013.01); *A63B 69/3661* (2013.01); *A63B 69/3667* (2013.01); *A63B 69/38* (2013.01); *A63B 71/022* (2013.01); *A63B 2069/0008* (2013.01); *A63B 2071/009* (2013.01); *A63B 2071/0063* (2013.01); *A63B 2071/024* (2013.01); *A63B 2071/026* (2013.01); *A63B 2071/065* (2013.01); *A63B 2071/0694* (2013.01); *A63B 2209/10* (2013.01); *A63B 2210/50* (2013.01); *A63B 2220/53* (2013.01); *A63B 2225/093* (2013.01)

(58) Field of Classification Search

USPC ..... 473/427, 428, 429, 430

See application file for complete search history.

(56) References Cited

U.S. PATENT DOCUMENTS

| | | | | |
|---|---|---|---|---|
| 2,578,313 | A * | 12/1951 | Moseley | 473/426 |
| 2,777,697 | A * | 1/1957 | Crossot | A63B 69/3667 473/218 |
| 3,118,670 | A * | 1/1964 | Smith | A63B 69/0091 473/429 |
| 3,663,018 | A * | 5/1972 | O'Leary | A63B 69/0091 473/149 |
| 3,809,777 | A * | 5/1974 | Thompson | 426/438 |

(Continued)

*Primary Examiner* — Gene Kim
*Assistant Examiner* — Michael Chambers
(74) *Attorney, Agent, or Firm* — K&L Gates LLP

(57) ABSTRACT

A sports practicing system includes: a lever arm including an aperture; at least one ball secured to the lever arm; a pivot about which the lever arm rotates; an upper member to which the pivot is connected, the upper member including first and second ends; a base for placement on a ground, the base supporting the upper member; and an elastic strap stretched from the first end of the upper member to the second end of the upper member, an inner portion of the strap intersecting the pivot so the strap deflects the lever arm and the ball when the lever arm rotates about the pivot due to the ball being struck.

19 Claims, 15 Drawing Sheets

(56) References Cited

U.S. PATENT DOCUMENTS 3,861,679 A * 1/1975 Culpepper ..... 473/429
3,908,990 A * 9/1975 Spurgeon ..... A63B 69/0091 473/429
4,664,375 A 5/1987 Tetreault
4,699,377 A * 10/1987 Ponza ..... A63B 69/0091 473/429
4,805,913 A * 2/1989 Bott ..... A63B 69/3667 273/DIG. 30
4,932,656 A * 6/1990 Pierce ..... A63B 69/3667 473/452
5,318,290 A 6/1994 Sawyer
5,377,976 A * 1/1995 Matherne et al. ..... 473/483
5,467,978 A * 11/1995 Paluch ..... A63B 69/0079 473/429
5,467,979 A * 11/1995 Zarate ..... A63B 69/0091 473/429
5,472,186 A * 12/1995 Paulsen ..... A63B 69/0091 473/429
5,494,278 A * 2/1996 Linden ..... A63B 69/0091 473/427
5,553,848 A * 9/1996 Amron ..... A63B 69/0002 473/416
5,601,286 A * 2/1997 Fierbaugh ..... A63B 69/0091 473/429
5,624,113 A * 4/1997 Rabine ..... 473/430
5,642,880 A * 7/1997 Wiseman ..... A63B 69/0002 473/417
5,788,589 A * 8/1998 Koo ..... A63B 69/0091 473/429
5,947,833 A 9/1999 Alward
5,989,137 A * 11/1999 Krueger ..... 473/423
6,220,974 B1 * 4/2001 Moore ..... 473/430
6,926,625 B1 * 8/2005 Fruechting ..... A63B 69/0002 473/218
7,070,520 B1 * 7/2006 An ..... 473/422
7,951,019 B1 * 5/2011 Lozado ..... A63B 69/0002 473/422
8,535,179 B2 9/2013 Kanner et al.
8,585,516 B1 * 11/2013 Buono ..... A63B 69/0075 473/422
2002/0111233 A1 * 8/2002 Lloyd ..... 473/429
2005/0143200 A1 * 6/2005 Hedgepath ..... A63B 69/0002 473/452
2007/0173356 A1 * 7/2007 Hapanowicz ..... 473/451
2011/0165970 A1 * 7/2011 Lesniewicz ..... A63B 69/38 473/426
2013/0053188 A1 * 2/2013 Moore ..... 473/423
2013/0157785 A1 * 6/2013 Connors ..... 473/429

* cited by examiner 94
447.
92

86, 186
86, 186
90
56
56a
54c 52a, 52b
54
56b
70
74b
86

74a
50
70
80
1
56
56a
54c
12

52a, 52b
56b
54b
54
54a
12

346a
340
110b
348a
326
310
360b
332
360a
322
334
330
324
320
344
360
360a
360a
394
346
342
392
348b 386
350
360
360
352
376
354
354
382
372
100a
370
360b
360b
400
346b
380
400
396b
378
374
402
398b
404
400
400
402
406
356a
358a
406
406
12
402
402
16
30
18
20a

SPORTS PRACTICING SYSTEM AND METHOD

PRIORITY CLAIM

This application claims priority to and the benefit of U.S. Provisional Application No. 61/,660,480, filed Jun. 15, 2012, and Provisional Application No. 61/576,643, filed Dec. 16, 2011, both entitled "Sports Practicing System And Method".

BACKGROUND

The present disclosure relates to sports practicing systems and methods and in particular to the practice of baseball, tennis and golf.

Baseball practicing devices, such as baseball batting practicing devices, are known. Certain systems attempt to constrain the practicing batter's feet. While such constraint may initially place the batter's feet in a proper position, the constraints do not allow the batter's feet to move, which is needed in a proper baseball batting swing.

Other systems are bulky and require heavy framing, making those systems cumbersome, relatively expensive and ill-suited for transport.

Still other systems require a modification to the ground beneath which the system is placed. Those systems are time consuming to install and are likely restricted to outside use.

Further still, certain baseball batting practice systems operate with batting tee. While batting tees are very useful in aiding a player to focus purely on his or her swing, without having to time the swing with a live pitch, the batting tee has certain limitations. First, a ball has to be set on the tee for each swing. With the batter attempting to focus on his or her swing, it is much easier to have a productive practice session with another person loading the tee. But another person might not always be available, especially in a situation in which multiple players may be practicing together at the same time. Second, the ball will travel off of the tee, requiring space for the balls to travel without causing destruction or a secondary net or backstop to capture the balls. In either case, multiple baseballs are required and will have to be retrieved.

Many of the above problems apply to the practice of other sports, such as tennis and golf. For all of the above reasons, it is believed that an improved sports, and in particular baseball, practicing system is needed.

SUMMARY

The present disclosure sets forth a baseball practicing system and method. In particular, the system and method enable a player of any skill level to practice hitting a baseball, golf ball or tennis ball. For each sport, the system and method aids both the player's hitting footwork and hitting swing in one embodiment. It should be appreciated that the system and method could only employ the footwork portion or the swinging portion of the present disclosure if desired. That is, the footwork portion of the present disclosure could be used in conjunction with a known batting tee. Further alternatively, the batting swing portion of the present disclosure could be used without the footwork training portion.

In an embodiment, the system includes a base mat. The base or mat can be a rubber mat that is thick enough to lay flat and withstand wind gusts and other outside environmental factors, such as rain and snow. The mat is also thick enough in an embodiment to support a ball holding assembly that holds a ball, such as a baseball, tennis ball or golf ball in a position so as to be struck for practice by a player. The mat can be a continuous mat or be a combination of mats overlaying each other as discussed further below. The mat in an embodiment is thin enough and flexible enough to be rolled-up for storage and transport.

The mat includes a player side and an equipment or ball positioning side, which is true regardless of the sport played. The player side is also set regardless of whether the player bats, golfs or plays tennis right-handed or left-handed. The player side will employ the footwork portion of the present system and method because the player stands on that side. The ball positioning side includes the apparatuses used to position and hold a ball, such as a baseball, tennis ball or golf ball, in place for being hit.

The player side of the mat is fitted with one of a pile or hook material in one embodiment. The hook or pile material can be placed over the entire surface of the mat, only on areas of the mat needing the material potentially, as strips of material applied over the entire surface of the mat, or as strips of material applied only on areas of the mat needing the material potentially.

The system is provided with a plurality of foot-shaped placement markers. The foot-shaped markers can be provided in different sizes to match the footprint of a younger user, teenage user or adult user. Or, the foot-shaped markers are provided in a larger size for all users. In an embodiment, the foot-shaped pieces or markers are provided as two left foot pieces and two right foot pieces. The markers are made of a material upon which the player can step during a swing, such as a baseball, tennis or golf swing. The placement marker material should not be too slick, such that the player slips on the piece material during the course of a swing. The placement marker material should also not be too gnarly, such that the player's foot is caught by or becomes tangled with the marker material during the course of a swing. The placement marker material can be made for example of the same, e.g., rubber, material as the mat material. In an especially suitable embodiment, the placement marker material is artificial turf or synthetic grass. The artificial grass is rugged and can be of a short pile height to reduce cost.

The bottom side of each foot-shaped placement marker is provided with the other of the hook or pile material not applied to the mat. The entire bottom side of each foot-shaped placement marker can be provided with the other of the hook and pile material. Alternatively, only selected portions or strips of the bottom side of the placement markers are provided with the other of the hook and pile material.

The mating of the hook and pile material between the underlying mat and the placement markers enables the foot-shaped pieces to be placed at any desired position and in any desired orientation on the player side of the mat. The moveable placement of the foot-shaped pieces or marker enables the player (or a trainer of the player) to create a foot pattern that sets forth a proper starting swing stance and a proper ending swing stance, i.e., the proper or desired position of the player's feet after a swing has occurred. For example, a right-handed batter may use a single right-footed placement marker and two left-footed placement markers. The single right-footed placement marker marks where the right-handed batter's rear foot should reside, and how the rear foot should be oriented, e.g., with respect to home plate, before and after the player's swing. One of the left-footed placement markers is used to mark or spot the player's starting front foot position and orientation. The second of the left-footed pieces or markers is used to mark where the player's front foot should be, and the orientation of the front foot, e.g., with respect to the plate, after the player's swing has been completed. A left-handed batter, it should be appreciated, would use a single left-footed placement marker for the player's back foot positioning and orientation, and use two right-footed pieces for the player's front foot positioning before and after the swing.

A baseball plate or golf ball holding tee is provided in one embodiment. As discussed herein, the mat includes hook or pile material (area or strips) in the area in which the plate or tee may be positioned and oriented. The bottom side of the plate or holding tee, like the placement markers, is provided with the mating other of the hook or pile material. Or, the baseball plate or golf tee may be heavy enough that hook and pile releasable securement is not needed. In any case, it is contemplated to allow the plate and/or golf ball holding tee to be oriented changeably as desired with respect to the player side of the mat, e.g., to accommodate both a right-handed and a left-handed batter.

The equipment or ball positioning side of the mat is provided with a ball holding assembly in one embodiment. In one primary embodiment, the ball holding assembly is anchored by at least two anchors provided for example in opposing corners of the mat on its ball positioning side. The anchors can be pegs that are secured to the mat, e.g., secured via universal or hinge bases to the mat, so that the pegs can be folded down when not used and oriented in a desired direction when in use.

A lower end of a mounting member or leg is fitted over each peg. The mounting members can be metal or plastic tubes or pipes, for example. A metal or plastic bending rod is bent and placed at each of its ends in the open upper ends of each mounting member. The rod is fixed at its ends to the upper ends of the mounting members via locking pins in one embodiment. Or, the upper ends of the mounting members can be crimped a few inches or centimeters below the ends to accept like few inches or centimeters of the ends of the flexible rod, which are wedged into the crimps.

The hinged mounting pegs, mounting members and bendable rod form an upside down "U" or "V" shape. That upside down "U" or "V" shape is angled inwardly (i) from the anchored mounting pegs located at the outer edge corners of the equipment side of the mat (ii) towards a center of the mat. The upside down "U" or "V" shape is supported or held at the angled-in position by a strap or cord, such as a bungee type stretchable cord, which extends up from the mat, around the top, middle of the upside down "U" or "V" shape, back down to the mat. The strap or cord hooks at each end to a base bracket, which can be a metal plate that is positioned beneath the mat. First and second loops extend up from the plate through the mat. The hooked ends of the strap or cord hook respectively to the first and second loops. The upside down "U" or "V" shape is compressed to the mat by the stretched cord, which forms a plane that is generally perpendicular to the plane formed by the upside down "U" or "V" shape, forming a four-legged ball holding structure.

A second strap or bungee cord hangs vertically down from the top of the upside down "U" or "V" shape, which is angled inwardly so that the top of the "U" or "V" shape resides over the approximate center of the mat. The second strap or cord supports a ball, e.g., a baseball, tennis ball or golf ball at its end. The ball can have a hole or bore through which the strap or cord is extended and knotted at its end to hold the ball. The ball hangs over the centerline of a baseball plate, tennis hitting area, or golf ball hitting area at a vertical location suitable for the user to strike. The second strap or cord can be adjusted, e.g., slid, relative to the first cord to raise or lower the ball to a desired location. The second cord is then secured to the first cord via fasteners, such as hook and pile straps, which can be easily undone and redone to adjust the ball height.

In a second primary ball holding assembly embodiment, the first strap or cord and its associated base bracket are not used or needed. The upside down "U" or "V" shape is instead supported at the inward angle by pairs of struts, one or two each supporting one of the mounting members. The mounting members and the struts each extend to the mat, creating, e.g., a four, five or six point contact between the alternative ball holding assembly and the mat. Each of the four, five or six points of contact is secured to the mat by a securing pin that extends up through the mat and secures to, e.g., threads into, mounting members and support struts. To this end, each of the lower ends of the mounting members and support struts can have internal threads or internally threaded inserts, which receive threaded rod sections of the securing pins. The securing pins can have spherical balls threaded or welded onto each of the threaded rods. The spherical balls reside below the mat and allow the threaded rods to extend up through the mat in any needed direction.

The upper ends of the struts can also be formed with internal threads or threaded inserts that receive the threaded securing pins to fasten the upper ends of the struts to the upside down "U" or "V" shape while tilted or angled inwardly a desired amount. The mounting members of the upside down "U" or "V" shape are provided with apertures that are angles to align with the upper ends of the support struts. The securing pins are inserted downwardly through the apertures in the mounting members and are secured, e.g., threaded, into the tops of the support struts. The resulting ball holding assembly uses on the order of six to ten securing pins (depending upon how many struts are used) and forms a solid, stable structure that is secured, e.g., bolted to, the mat.

The ball holding strap or cord is provided again in the second ball holding assembly embodiment. The strap or cord can be untightened and/or unspooled from a member of the second assembly to raise or lower the ball for example. The strap or cord is slid against and fastened at a desired distance to one of the members of the upside down "U" or "V" shape.

Third, fourth and fifth primary ball holding assemblies are also disclosed. Each embodiment includes a dual ball holding lever arm that pivots about a central pivot. When one of the balls is struck, the lever arm pivots and hits a tensioned strap in two places, which reverses the course of the pivoting lever arm and reduces its momentum. The strap causes the lever arm to reverse course a plurality of times, slowing the ball so that it can be hit again. Thus the third, fourth and fifth assemblies automatically reload and, for example, pitch a baseball back towards the player for re-striking.

The third, fourth and fifth primary ball holding assemblies include an upper subassembly, including the dual ball holding pivoting lever arm, connected removably to a lower base assembly. The lower base assembly can be weighted, e.g., internally via sand or externally with weights or sandbags, and/or be staked or pinned to the ground to hold the subassemblies sturdily in place during use. The assembled upper and lower subassemblies can be used indoors or outdoors. The upper subassembly is removable from the lower assembly in one embodiment so that it can be attached releasably to a fence or vertical support member, in which the vertical support member supports the upper subassembly instead of the lower subassembly during operation while the ball is struck.

The first to the fifth primary embodiments of the ball holding assembly can be pulled apart and rolled up readily with or within the mat. The assemblies break down essentially into straight tubes, pipes, cords, a ball and loose pieces that can be placed into a bag if needed, all of which may be rolled up into the mat for ready transport.

It is contemplated to break the ball holding strap or cord and place a strain gauge or force sensor in between the break, so that the force of the player's impact on the ball can be measured. The strain gauge or force sensor can output to a readout that will provide a relative output, e.g., number, graphic or word, to give the player and/or an instructor a sense of how well the player is performing. The strain gauge or force sensor and the readout can be battery or AC powered. The electronics are provided in sturdy packaging for transportation with the system.

A golf practicing section or patch is provided and which replaces the home plate for the practice of golf. The patch includes a golf tee and removably attaches to the system mat, e.g., via hook and pile attachment. An embodiment for suspending a golf ball from a strap is also illustrated and explained herein.

It is accordingly an advantage of the present disclosure to provide a sports practicing system and method that can be used for multiple sports, such as baseball, tennis and golf.

It is another advantage of the present disclosure to provide a baseball practicing system and method that helps the batter's footwork and upper swing if desired.

It is a further advantage of the present disclosure to provide a sports practicing system and method that is relatively mechanically simple.

It is still a further advantage of the present disclosure to provide a sports practicing system and method that is portable.

It is yet another advantage of the present disclosure to provide a sports practicing system and method that is auto-resettable for user interaction and/or moves a back towards the user as if the ball were being hit or pitched towards the user, reducing a momentum of the ball so that the ball can be struck again.

Still another advantage of the present disclosure is to provide a sports practicing system and method that can be used indoors or outdoors.

Still a further advantage of the present disclosure is to provide a baseball practicing system and method that does not require a batting tee, multiple baseballs or a backstop or open area to absorb the energy of a moving baseball.

Further still, it is an advantage of the present disclosure to provide a sports practicing system and method that can be used in a relatively confined space.

Additional features and advantages are described herein, and will be apparent from the following Detailed Description and the figures.

DETAILED DESCRIPTION

First Primary Embodiment

Figure 1:
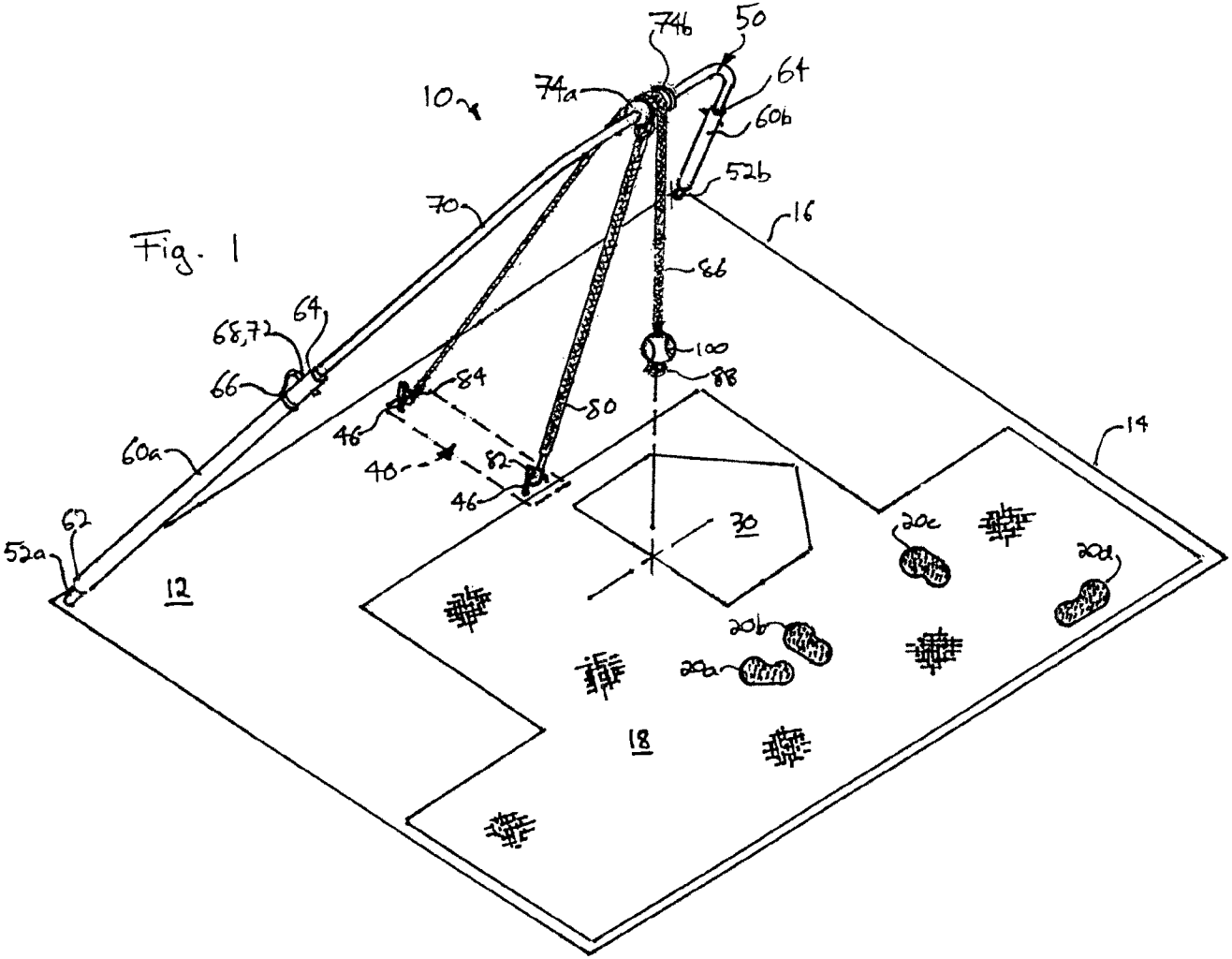
FIG. 1 is a top-front-left side perspective view of one embodiment of a sports practicing system of the present disclosure.
Figure 2:
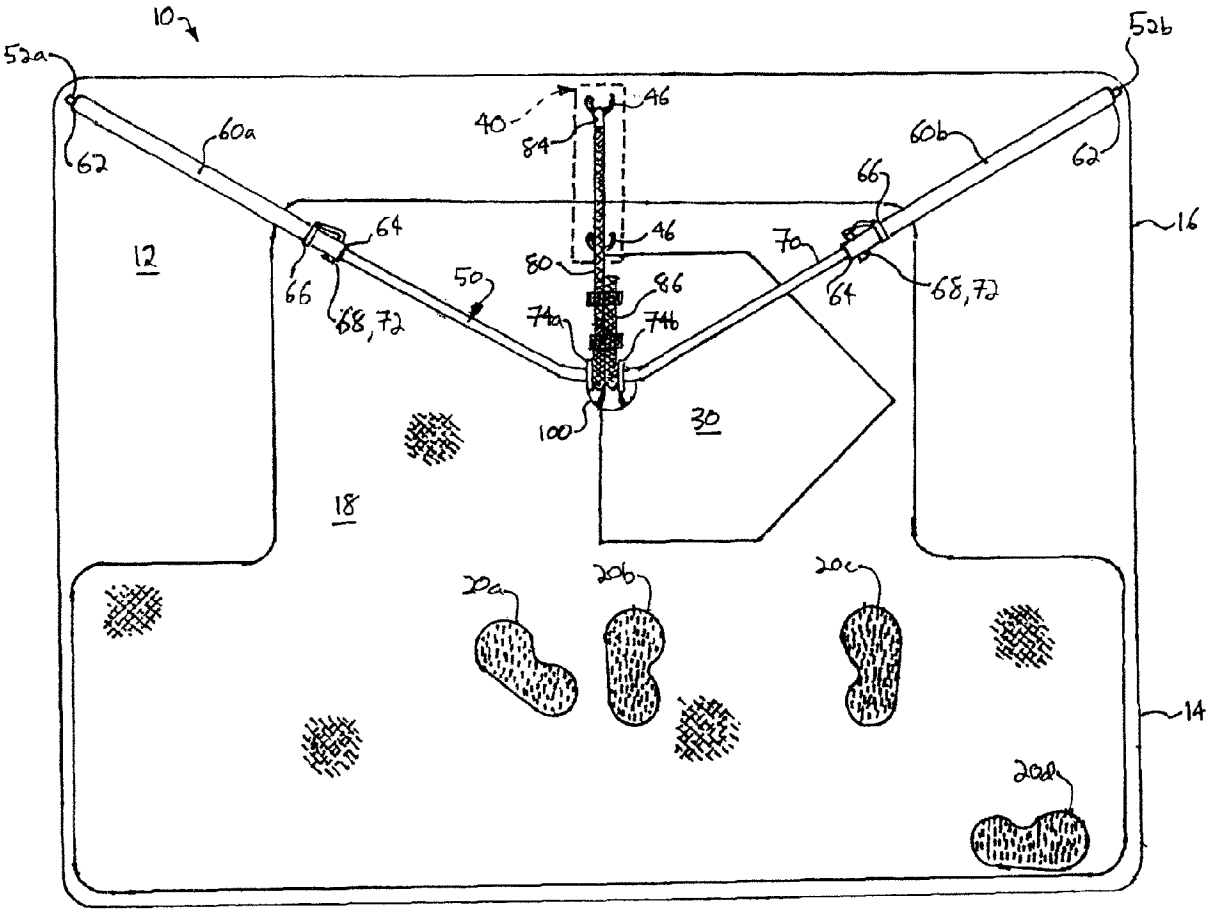
FIG. 2 is a top view of one embodiment of a sports practicing system of the present disclosure.
Figure 3:
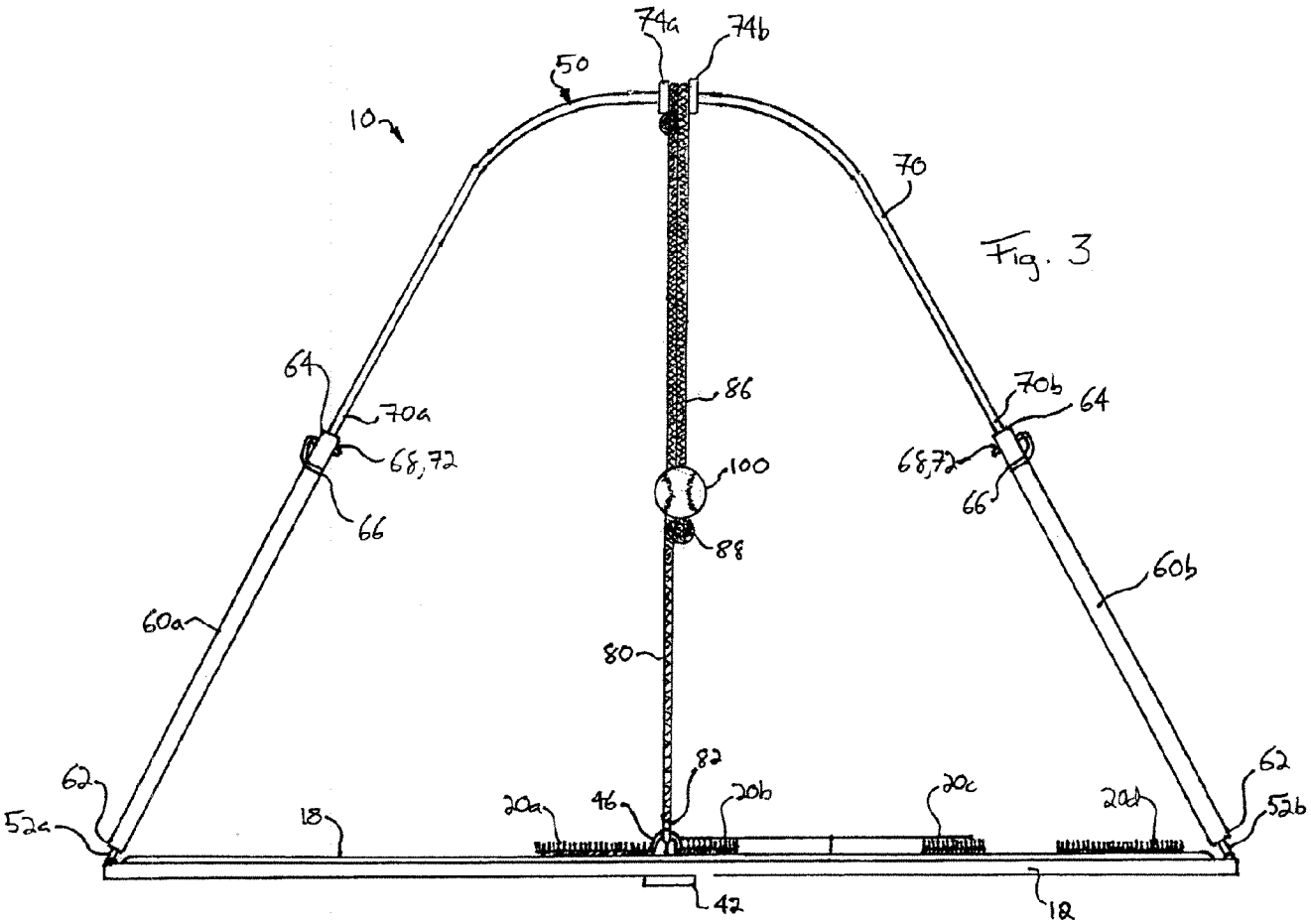
FIG. 3 is a front elevation view of one embodiment of a sports practicing system of the present disclosure.

Referring now to the drawings and in particular to FIGS. 1 to 7, one primary embodiment of a sports practicing system and associated method of the present disclosure is illustrated by system 10. System 10 is illustrated in FIGS. 1 to 3 for the sport of baseball. As discussed in detail herein, however, system 10 is not limited to baseball and may be used for other sports, such as tennis and golf, for example.

System 10 includes a base or mat 12. Mat 12 can be plastic or rubber for example. In one preferred embodiment, mat 12 can be rolled-up for easy transport and ready storage. Mat 12 in an embodiment is a black, rubberized mat made of any suitable material, such as any material used for workout or workout equipment related mats. Mat 12 can be used indoors and outdoors. In one preferred embodiment, mat 12 does not need to be anchored to the earth and modification to the ground of the existing indoor or outdoor environment is not necessary.

Mat 12 in an embodiment includes a player side 14 and an equipment or ball positioning side 16. Player side 14 and equipment or ball positioning side 16 are set regardless of whether the player is right-handed or left-handed. Thus it is contemplated for system 10 to allow a baseball player to practice hitting right-handed and then left-handed or vice-versa with very little modification to the system.

Player side 14 of mat 12 includes a pile or hook material area 18. Pile or hook material area 18 can span all of player side 14, or even all of mat 12, or be placed on selective portions of mat 12 as illustrated in FIGS. 1 and 2. In the illustrated embodiment, pile or hook material area 18 spans all of player side 14, in which the player's feet may reside for hitting a baseball, tennis ball or golf ball for example. Pile or hook material area 18 also extends to where home plate 30, golf ball tee (FIG. 11) or other player aid resides, so that home plate 30 can be removably attached to mat 12 via hook and pile attachment. Pile or hook material area 18 can be a continuous piece as illustrated or be made of strips or other discontinuous sections of pile or hook material. Pile or hook material area 18 can be adhered to and/or sewn or otherwise mechanically fixed to mat 12.

FIGS. 1 to 4 illustrate foot placement markers 20*a* to 20*d*. Foot placement markers 20*a* to 20*d* can be made of rubber, plastic, carpet or fabric, such as a woven fabric. In the illustrated embodiment, foot placement markers 20*a* to 20*d* are made of artificial turf having an artificial turf backing 22 and grass-like fibers 24 stitched to, sown within or otherwise secured by backing 22. The artificial turf backing 22 or other material is cut into the shape of a foot or shoe. FIGS. 1 and 2 illustrate that system 10 in one embodiment provides two left-footed placement markers 20*a* and 20*b* and two right-footed placement markers 20*c* and 20*d*. Providing two of each left-footed placement markers 20*a*, 20*b* and right-footed placement markers 20*c*, 20*d* allows for a spare in case a pad becomes lost or damaged, allows for two feet placement settings, and allows for before and after swing positions to be marked as illustrated in FIGS. 1 and 2.

Figure 4:
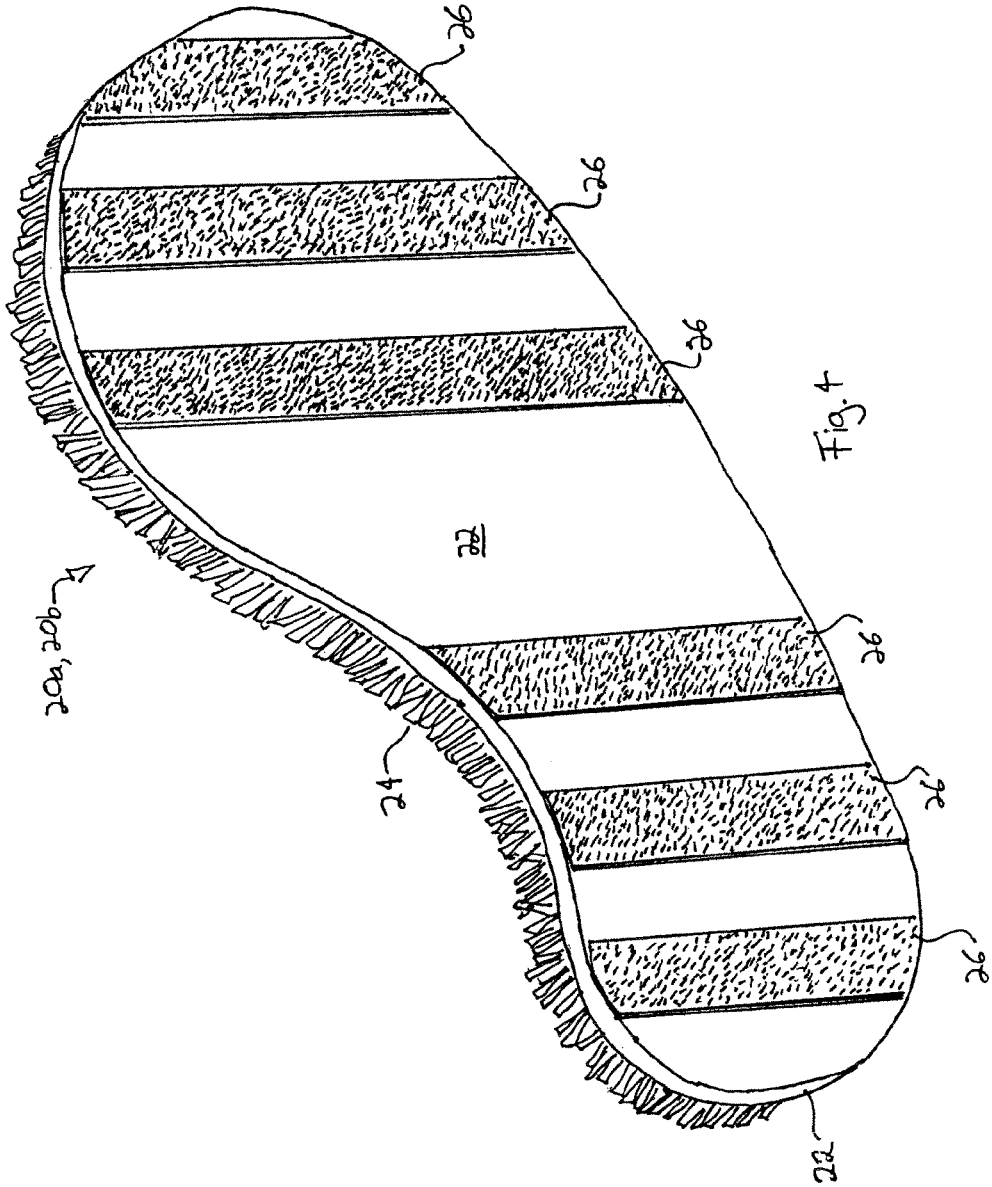
FIG. 4 is a bottom perspective view of one embodiment of a foot placement marker of the present disclosure.

Foot placement markers 20*a* to 20*d* each include hook or pile strips or sections 26 adhered and/or mechanically attached to their underside as illustrated in FIG. 4. Hook or pile strips or sections 26 enable foot placement markers 20*a* to 20*d* to be desirably and removably attached anywhere on pile or hook material area 18. In the illustrated embodiment, the two left-footed placement markers 20*a* and 20*b* and single right-footed placement markers are used for a right-handed baseball player.

Although not illustrated, home plate 30 also includes adhered to and/or mechanically attached hook or pile strips or sections similar to strips or sections 26. Home plate 30 in an embodiment is a thin piece of rubber or plastic that can be rolled along with mat 12 for transport.

Foot placement markers 20*b* and 20*c* are placed to show the player the proper place to stand relative to home plate 30 before the player swings, taking into account for example the player's size. Left-footed placement marker 20*a* is spaced away from and turned relative to left-footed placement marker 20*b*. Left-footed placement marker 20*a* is placed where the player's foot should be after the player swings and hits the ball. Left-footed placement marker 20*a* is also turned to show how the player's leg should turn and open during a proper baseball swing. Similar foot positioning can be made for a golf or tennis swing. Foot placement markers 20*a* to 20*d* allow feet settings to be made for a left-handed or right-handed player.

It is believed that artificial turf foot placement markers 20*a* to 20*d* provide tactile feedback to the player as the player is swinging so that the player does not have to look down at the foot pads and take his or her eye off the ball. The player will stand properly in pads 20*b* and 20*c* before the swing. The player will also look at and mentally note where post swing pad 20*a* resides. The player can also see how close the player's foot came to the proper location of post swing pad 20*a* after the player's swing. After a few swings and self-correction, the player's footwork should become proper, and after repetition, hopefully carry over to live play. The player can also feel the grass-like fibers 24 during the player's swing. Grass-like fibers 24 provide a surface that is not slippery for traction but that also do not grab or catch the player's shoe, allowing the player to move his or her feet freely.

FIGS. 1 to 3 illustrate that sports system 10 includes a ball holding assembly 50. While ball holding assembly is illustrated holding a baseball 100, it should be appreciated that assembly 50 could instead hang a golf ball or tennis ball in the same manner as baseball is shown being held.

Ball holding assembly 50 includes a base bracket 40. Base bracket 40 is described in more detail below in connection with FIG. 5. Base bracket 40 is located on the underside of the equipment side of mat 12. In one embodiment, base bracket 40 is attached removably to the underside of mat 12 via a hook and pile connection. Loops 46 of base bracket 40 extend up from the top of the base bracket, through corresponding slots formed in mat 12 (not illustrated), so that the loops are exposed and accessible on the top surface of the equipment side 16 of mat 12. Loops 46 can be welded to, hinged to, or formed with base bracket 40.

Base bracket 40 in the illustrated embodiment is an elongated rectangular slab that is shaped, sized and weighted to help keep ball holding assembly 50 stable throughout the flight of ball 100 after being struck and until ball 100 comes to rest in the position shown in FIGS. 1 to 3. It is contemplated that base bracket 40 could have other shapes that aid in the stability of ball holding assembly 50 and system 10. The shape in an embodiment can either be rolled up with mat 12 having base bracket 40 in place for the transport of system 10 or be removed from mat 12 and rolled up with mat 12 for transport. While a single base bracket 40 is illustrated in FIGS. 1 to 3, ball holding assembly 50 could be provided alternatively with multiple base plates as needed to provide adequate stability to system 10.

Ball holding assembly 50 also includes hinged mounting pegs 52*a* and 52*b* that are attached to mat 12 at respective corners of the equipment side of mat 12. Hinged mounting pegs 52*a* and 52*b* are described in more detail below in connection with FIGS. 6A and 6B. Hinged mounting pegs 52*a* and 52*b* in an embodiment include pegs 56 that extend up from mat 12, and which can move relative to a base portion 54 of hinged mounting pegs 52*a* and 52*b*, which is fixed to mat 12. The pegs 56 can be coupled in a universal joint manner to base portion 54 of hinged mounting pegs 52*a* and 52*b*, providing a large degree of freedom to rotate the pegs. The pegs 56 can thus fold down against mat 12 to roll mat up for transport. The pegs 56 can also be rotated upwardly to a desired angle to meet and mate with mounting members 60*a* and 60*b*.

In an embodiment, mounting members 60*a* and 60*b* are tubular and fit over the pegs 56 of mounting pegs 52*a* and 52*b* to assemble ball holding assembly 50. Mounting members 60*a* and 60*b* can be metal, e.g., steel, stainless steel or aluminum, or plastic, e.g., hard polyvinyl chloride ("PVC") tubing or pipe. It should be appreciated however that the rotatable pegs 56 of mounting pegs 52*a* and 52*b* could alternatively be tubular and sized such that mounting members 60*a* and 60*b* fit into the mounting pegs 52*a* and 52*b*.

Mounting members 60*a* and 60*b* each include a mat end 62 and a bending rod end 64. Mat ends 62 of mounting members 60*a* and 60*b* are connected to mounting pegs 52*a* and 52*b* in any of the manners just described (e.g., fitted over or into the mounting pegs). Bending rod ends 64 of mounting members 60*a* and 60*b* each receive an end of bending rod 70. The ends of bending rod 70 fit inside of bending rod ends 64 of mounting members 60*a* and 60*b* in the illustrated embodiment. In an alternative embodiment, the ends of bending rod 70 are tubular and sized such that bending rod ends 64 of mounting members 60*a* and 60*b* fit inside of the ends of bending rod 70.

In the illustrated embodiment, bending rod ends 64 of mounting members 60*a* and 60*b* are each provided with a tethered locking pin 66. The tethering of locking pins 66 to mounting members 60*a* and 60*b* prevents the locking pins from becoming lost when not being used to help hold ball holding assembly 50 together. The tethering also provides enough degree of movement, such that a user can readily grasp locking pins 66 and insert same though mated locking pin holes 68 (through mounting members 60*a* and 60*b*) and 72 (through bending rod 70). Tethered locking pins 66 can be metal, such as steel, stainless steel or aluminum, or plastic, such as PVC. Tethered locking pins 66 can be tethered or tied to mounting members 60*a* and 60*b* via a bendable plastic, rubber or material, e.g., leather, strip.

In an alternative embodiment, tethered locking pins 66 are not provided and bending rod ends 64 of mounting members 60*a* and 60*b* are instead crimped a distance, e.g., a few inches or centimeters, from the very tips of mounting members 60*a* and 60*b* to accept like sized sections, e.g., a few inches or centimeters, of the ends bending rod 70. The ends of bending rod 70 press-fit into the crimps of mounting members 60*a* and 60*b* for removable attachment thereto.

Bending rod 70 is made of bendable metal, plastic, composite material, or some combination or derivative thereof. Bending rod 70 can be circular or polygonal in cross-section. Bending rod 70 can also be bent generally along one radius to create a top semi-circular or domed shape, or alternatively be bent along two different radii, such that there is a generally straight horizontal section in the middle of bending rod 70, between the bends, at the top of the bent rod 70. In an embodiment, bending rod 70 is made of a material that unbends and returns to its original straight shape when a bending force is removed from the rod. This allows rod 70 to be rolled up with mat 12 when the mat needs to be transported. Such structure also means that rod 70 will want to spread outwardly when bent and be inserted into position for system 10 as shown in FIGS. 1 to 3, causing rod 70 to apply a rigidity-providing force to ball holding assembly 50, which helps to hold assembly 50 together.

As illustrated in FIGS. 1 to 3, the upside down "U" or "V" shape formed by mounting members 60*a* and 60*b* and rod 70 of ball holding assembly 50 is supported or held at an angled-in location (so that the top of the upside down "U" or "V" shape extends over plate 30) by a strap or cord 80, such as a nylon strap or a bungee type stretchable cord, which extends up from the mat 12, around the top of the upside down "U" or "V" shape at the middle of bending rod 70, back down to the mat 12. Strap or cord 80 includes a hook 82 at the end of the strap located closer to plate 30 and a hook 84 located at the other end of the strap located closer to the edge of the ball positioning side 16 of mat 12. Hooks 82 and 84 each hook removably to a loop 46, attached or hinged to base bracket 40, extending up from underneath mat 12.

The upside down "U" or "V" shape of rod 70 and mounting members 60*a* and 60*b* is compressed to mat 12 by the stretched strap or cord 80, which forms a plane that is generally perpendicular to the plane of the upside down "U" or "V" shape. Overall then, the upside down "U" or "V" shape of rod 70 and mounting members 60*a* and 60*b*, and the stretched and anchored cord 80 form a four-legged ball holding structure. All four legs are in compression with mat 12 via the stretched anchoring of strap or cord 80.

A second strap or bungee cord 86 hangs vertically down from the top of the upside down "U" or "V" shape, which again is angled via strap 80 so that the top of the "U" or "V" shape resides over the approximate center of home plate 30. The second strap or cord 86 supports a ball, e.g., a baseball 100, tennis ball or golf ball 200 (FIG. 12) at its end. Ball 100 can have a hole or bore through which strap or cord 86 is extended and knotted at its end via a knot 88 to hold the ball. Knot 88 can be glued or banded together (e.g., via metal, plastic or rubber band(s) so that it cannot come inadvertently undone. In the illustrated embodiment, baseball 100 hangs over the centerline of home plate 30. For tennis, the ball can hang over a tennis hitting area. For golf, ball 200 hangs so as to reside on a hitting patch or a golf tee, e.g., artificial turf (FIG. 11), for striking.

Second strap or cord 86 can be adjusted, e.g., slid, relative to the first cord 80 to raise or lower the ball to a desired location. Second cord 86 is then secured to the first cord 80 via fasteners, such as hook and pile straps, which can be easily undone and redone to adjust the ball height. As illustrated by FIGS. 1 and 2, home plate 30 can be moved so that baseball 100 hangs over the front end of the plate, which is where certain experts recommend that contact be made with the baseball. Pile or hook material area 18 is large enough in the illustrated embodiment that home plate 30 can be moved such that baseball 100 hangs over any desired part of the home plate or even over a spot off of the plate.

Referring now to FIG. 4, one embodiment for foot placement markers 20*a* to 20*d* is illustrated. Left foot placement markers 20*a* and 20*b* are illustrated. It should be appreciated however that the teachings described for the left foot placement markers are equally applicable to all foot placement markers 20*a* to 20*d*. The markers are made of a material upon which the player can step during a swing, such as a baseball, tennis or golf swing. Foot placement markers 20*a* to 20*d* can be rubber, plastic, a fabric such as rug, or other suitable material. The foot placement marker material should not be too slick, such that the player slips on the material during the course of a swing. The foot placement marker material should also not be too gnarly, such that the player's foot is caught by or becomes tangled with the material during the course of a swing. The foot placement marker material can be made for example of the same, e.g., rubber, material as for mat 12.

In an especially suitable embodiment, the foot placement marker material is made of artificial or synthetic grass. The artificial grass is rugged and can be of a short pile height to reduce cost and to negate the need for an infill layer (e.g., sand or rubber) that holds longer pile height fibers upright to look like grass. The artificial turf includes a flexible backing 22, e.g., woven, that can be rolled up with mat 12 for transport. Backing 22 is tough for repeated use but is also thin so as not to create a step onto which the user has to climb, which could trip or otherwise bother the user who is concentrating on the ball. Grass-like fibers 24 are tufted into backing 22, holding fibers 24 secure and allowing for free ends of the fibers to extend up from backing 22 to emulate grass. Mat 22 and fibers 24 can each be polyurethane or polyethylene for example.

Foot-shaped markers 20*a* to 20*d* can be provided in different sizes to match the footprint of a younger user, teenage user or adult user. In the illustrated embodiment, foot-shaped markers 20*a* to 20*d* are provided as two left foot pieces and two right foot pieces. Additional or replacement pieces can be provided if desired.

FIG. 4 illustrates the bottom side of foot-shaped placement markers 20*a* and 20*b*. In an embodiment, the bottom of markers 20*a* to 20*d* is provided with the other of the hook or pile material not applied to section 18 of mat 12. The entire bottom side of each foot-shaped placement marker can be provided with the other of the hook and pile material. Alternatively, only selected portions, areas or strips 26 of the bottom sides of foot placement markers 20*a* to 20*d* are provided with the other of the hook and pile material.

Referring additionally to FIGS. 1 and 2, the mating of the hook and pile material between the underlying mat 12 and the placement markers 20*a* to 20*d* enables the foot-shaped markers to be placed at any desired position and in any desired orientation on the player side 14 of mat 12. The moveable placement of the foot-shaped markers 20*a* to 20*d* enables the player (or a trainer of the player) to create a foot pattern that sets forth a proper swing starting stance and a proper swing ending stance, e.g., the proper or desired position of the player's feet after a swing has occurred.

In the example of FIGS. 1 and 2, a right-handed batter may use or stand on a single right-footed placement marker 20*c* and two left-footed placement markers 20*a* and 20*b*. The single right-footed placement marker 20*c* is positioned to mark where the right-handed batter's rear foot should reside, and how the user's rear foot should be oriented, e.g., with respect to the batting plate, before and after the player's swing. Left-footed placement marker 20*b* is positioned to mark the player's starting front foot position and orientation. Left-footed marker 20*a* is positioned to mark where the player's front foot should be, and the orientation of the front foot, e.g., with respect to home plate 30, after the player's swing has been completed. A left-handed batter, it should be appreciated, would position a single left-footed placement marker 20*a* or 20*b* for the player's back foot positioning and orientation, and position the two right-footed markers 20*c* and 20*d* for the player's front foot positioning before and after the swing.

As discussed herein, home plate 30, like foot-shaped placement markers 20*a* and 20*b*, is also provided with the other of the hook or pile material not applied to mat 12. The entire bottom side of home plate 30 can be provided with the other of the hook and pile material. Alternatively, only selected portions, areas or strips (like strips 26 of foot-shaped placement markers 20*a* and 20*b*) are provided with the other of the hook and pile material. In this manner, home plate 30 can be adjusted relative to the foot-shaped placement markers 20*a* and 20*b*, and vice versa, which are all collectively adjustable relative to baseball 100, which itself can be raised or lowered. Thus, the player's feet can be set relative to home plate 30 before and after the player's swing at virtually any position desired by the coach or trainer, e.g., straight stance, open stance, closed stance, stance towards the front of the plate, stance towards the back of the plate, etc. It is also contemplated to provide a set of instructions for recommending to parents, trainers, users, etc., for the type of stance to use for a certain age and/or skill level, and how to position the foot-shaped placement markers 20*a* to 20*d* relative to home plate 30 and baseball 100 to achieve any of a plurality of the different stances.

Figure 5:
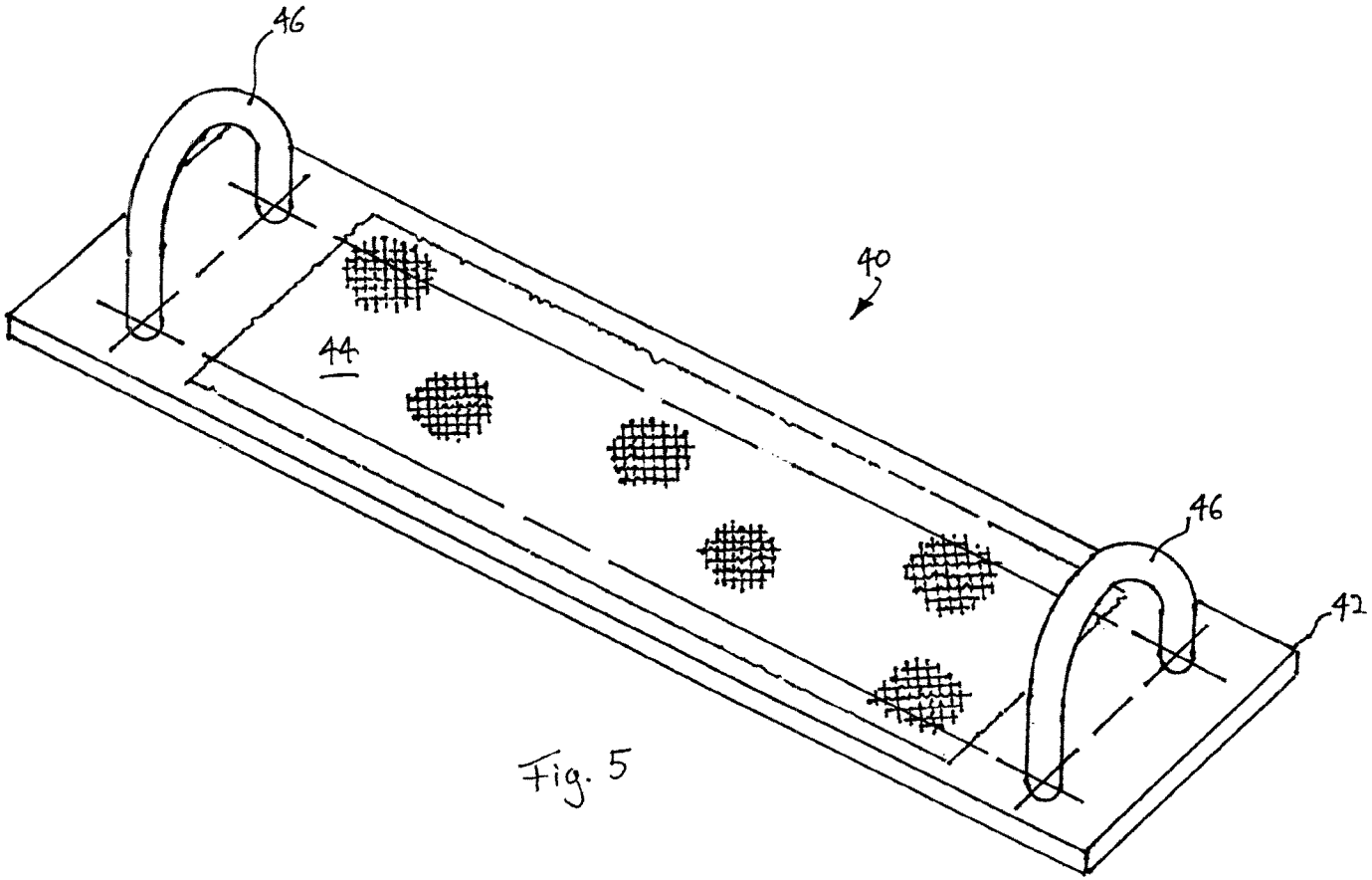
FIG. 5 is a top-front-left side perspective view of one embodiment of a mounting base of the present disclosure.

Referring now to FIG. 5, one embodiment for base bracket 40 is illustrated. Base bracket 40 in the illustrated embodiment includes an elongated rectangular, e.g., metal (such as steel, stainless steel or aluminum), hard plastic, or hard rubber base plate 42 that is shaped, sized and weighted to help keep ball holding assembly 50 stable throughout the flight of ball 100 after being struck. Loops 46 attached, e.g., welded to, or formed with base plate 42 extend up from a top surface of the base plate. Loops 46 in an embodiment are hinged to base plate 12.

In the illustrated embodiment, base plate 42 includes, e.g., is adhered to, pile or hook material 44 that attaches removably to the underside of mat 12, which in turn includes, e.g., is adhered to, the other of a hook or pile section (not illustrated). Either of the hook or pile material 44 or the pile or hook material applied to the underside of mat 12 can be formed as a single piece or as multiple pieces or strips as has been described elsewhere herein. The pile or hook material applied to the underside of mat 12 is located such that loops 46 can extend up through corresponding slots (not illustrated) formed in mat 12. Loops 46 are exposed and accessible on the top surface of the equipment side 16 of mat 12 to accept hooks 82 and 84 located the ends of cord or strap 80 as described above.

As mentioned above, base plate 42 can have other shapes that aid in the stability of ball holding assembly 50 and system 10. The shape of base late 42 in an embodiment allows bracket 40 to be rolled up in place with mat 12 for the transport of system 10 or to be removed from mat 12 and rolled up separately with mat 12 for transport. Hinged loops 46 fold down and out of the way for transport. While a single base bracket 40 is illustrated in FIGS. 1 to 3, ball holding assembly 50 could be provided with multiple base brackets, such as base bracket 40, as needed to provide adequate stability to system 10.

Figures 6A, 6B, 7, 10:
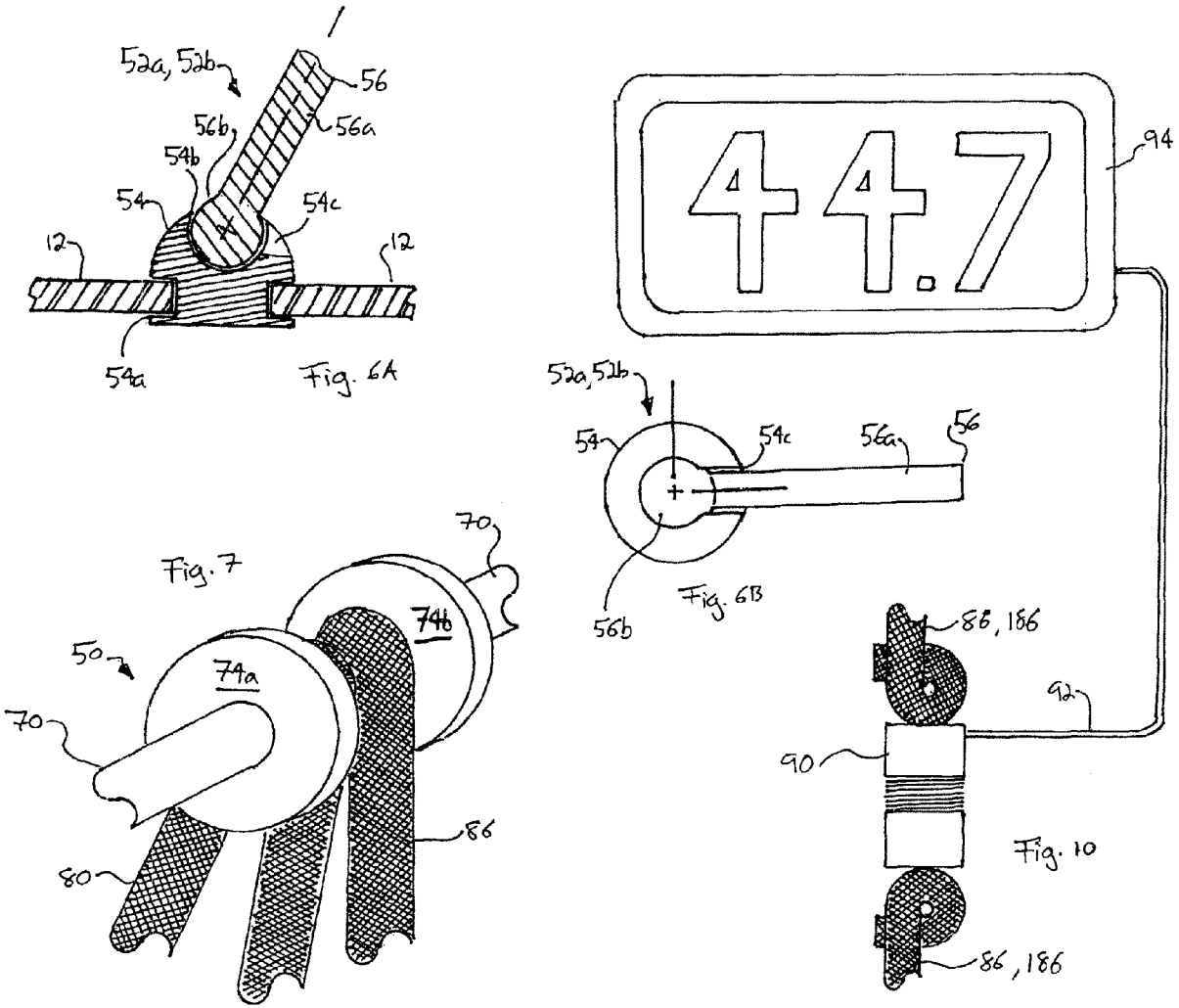
FIGS. 6A and 6B are sectioned elevation and top views respectively of one embodiment of a hinged mounting peg of the present disclosure.
FIG. 7 is a top-front-left side perspective view of one embodiment of a top portion of a ball holding assembly of the present disclosure.
FIG. 10 is a schematic view illustrating an embodiment of a force sensor and force readout feature of the present disclosure.

Referring now to FIGS. 6A and 6B, one embodiment for hinged mounting pegs 52*a* and 52*b* is illustrated. Hinged mounting pegs 52*a* and 52*b* (including all components thereof) are made of metal, hard plastic, hard rubber or any combination thereof and are attached to mat 12 at respective corners of the equipment side of mat 12. Thus in the illustrated embodiment of FIGS. 1 to 3, system 10 uses two mounting pegs 52*a* and 52*b* although system 10 can be provided with one or more spare mounting peg.

Hinged mounting pegs 52*a* and 52*b* in the illustrated embodiment include a press-fit or screw-together base 54, which includes or defines a mounting groove 54*a*, a spherical universal joint pocket 54*b* and a fold down slot 54*c*. Mounting groove 54*a* press-fits into and over a hole or aperture formed in mat 12. Alternatively, groove 54*a* is threaded, e.g., via internal female threads, and receives a matingly threaded cap, e.g., with male threads, which threads up from the bottom of mat to capture base 54 onto mat 12.

Hinged mounting pegs 52*a* and 52*b* in the illustrated embodiment also include pegs 56, each having a peg leg 56*a* that extends from a ball end 56*b*. Ball end 56*b* press-fits or is otherwise captured slidingly (e.g., smoothly) into universal joint pocket 54*b* such that peg 56 can rotate three-hundred sixty degrees within universal joint pocket 54*b*, allowing peg leg 56*a* to be received by, into or around the outside of mounting member 60*a* or 60*b* at the same or similar angle relative to horizontal mat 12 at which the mounting member 60*a* or 60*b* meets the mat. As illustrated, if mat 12 is taken as an X-Y plane, with the Z-axis pointing up from mat 12, mounting members 60*a* and 60*b* will have an angle in all three of the X-Y, X-Z and Y-Z planes. Ball end 56*b* and universal joint pocket 54*b* enable peg leg 56*a* to extend from mat at the same three-dimensional angle relative to the three planes.

Fold down slot 54*c* enables peg leg 56*a* to be folded down into the slot when ball holding assembly 50 is disassembled or pulled off of hinged mounting pegs 52*a* and 52*b*. Fold down slot 54*c* allows peg leg 56*a* to lay flat or relatively parallel to mat 12, so that the mat can more easily be rolled up for ready transport.

Referring now to FIG. 7, one embodiment for securing cords or straps 80 and 86 at the top of the upside down "U" or "V" shape formed by bending rod 70 is illustrated. Thickened washers or holding disks 74*a* and 74*b* can be formed with bending rod 70 or be secured to the bending rod, e.g., welded, adhered or bolted (e.g., via setscrew) to the bending rod. Holding disks 74*a* and 74*b* can be made of metal, plastic or rubber as can bending rod 70. Holding disks 74*a* and 74*b* in the illustrated embodiment are centered about the top or middle of bending rod 70 and are spaced apart from each other a distance that snugly holds and retains both cords or straps 80 and 86 in a manner such that the cords or straps 80 and 86 cannot slide down bending rod 70 even when ball 100 is struck and cord or strap 86 is moved. Holding disks 74*a* and 74*b* also help to guide cords or straps 80 and 86 together such that cord or strap 86 can be moveably fixed in a desired ball holding position to cord or strap 80 as has been described herein.

Second Primary Embodiment

Figure 8:
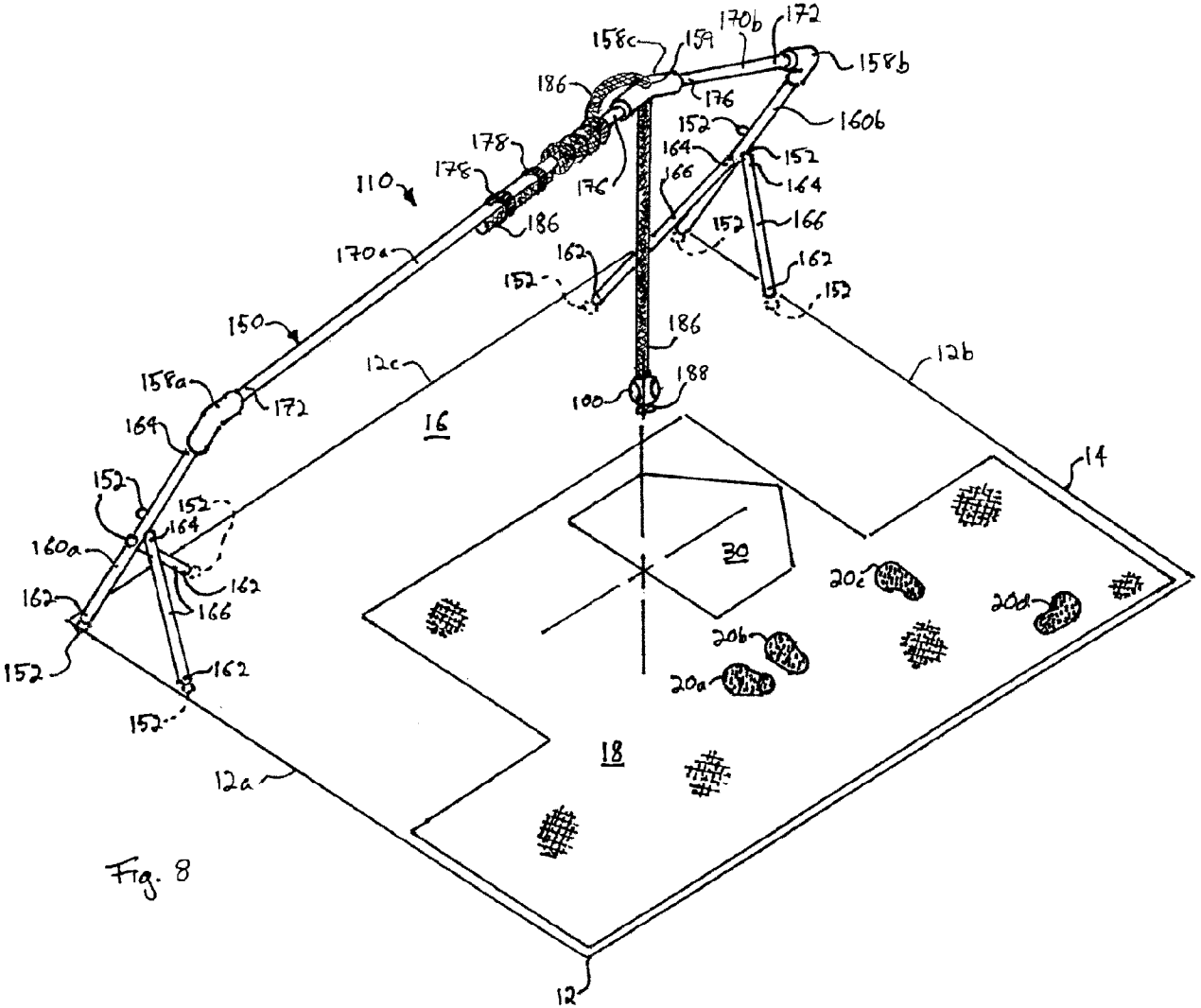
FIG. 8 is a top-front-left side perspective view of another embodiment of a sports practicing system of the present disclosure.
Figure 9:
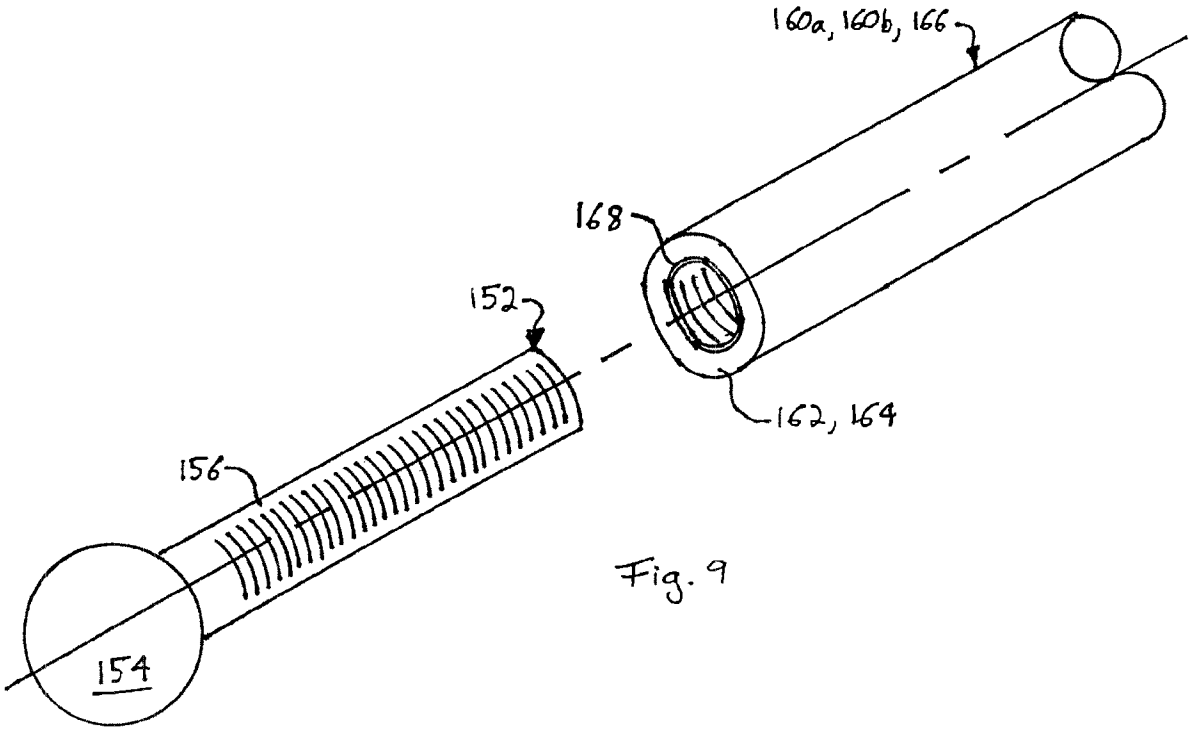
FIG. 9 is a top-front-left side perspective view of one embodiment of a mounting member/strut and securing pin connection arrangement for use with the alternative embodiment of FIG. 8.

Referring now to FIGS. 8 and 9, another primary embodiment of a sports practicing system and associated method of the present disclosure is illustrated by system 110. System 110 is illustrated in FIG. 8 for the sport of baseball. Just as with system 10 however, system 110 is not limited to baseball and may be used for other sports, such as golf or tennis, for example.

System 110 is the same as system 10 in many respects. System 110, like system 10 includes a mat 12, having a player side 14 and an equipment or ball positioning side 16. Player side 14 of mat 12 includes a pile or hook material area 18. Pile or hook material area 18 receives a home plate 30 and foot placement markers 20*a* to 20*d*, which are each moveably attachable to area 18 for desired positioning relative to ball or baseball 100. Any and all embodiments, materials and alternatives discussed above for any of the commonly numbered structures found in systems 10 and 110 are wholly and equally applicable to and contained by system 110 and its associated methodology.

The difference between system 110 and system 10 is that ball holding assembly 50 of system 10 is replaced by ball holding assembly 150 in system 110. It should be appreciated however that ball holding assemblies 50 and 150 serve the same primary purposes. With respect to baseball, for example, both ball holding assemblies 50 hold baseball 100 out over home plate 30 in a manner such that a practicing hitter can freely swing at the baseball without interruption from the ball holding assembly.

With alternative ball holding assembly 150, strap or cord 80 and base bracket 40 are not used or needed. Ball holding assembly 150 also includes an upside down "U" or "V" shaped structure. In the illustrated embodiment, the upside down "U" or "V" shaped structure includes four straight legs. Alternatively, the upside down "U" or "V" shaped structure includes three straight legs (two sides and one top) or two straight side legs and one bendable center leg like with ball holding assembly 50 of system 10. In the illustrated embodiment, the upside down "U" or "V" shaped structure of ball holding assembly 150 includes lower members 160*a* and 160*b* and upper members 170*a* and 170*b*. Lower members 160*a* and 160*b* each include a lower end 162 and an upper end 164. Upper members 170*a* and 170*b* each include a lower end 172 and an upper end 176. Upper end 164 of lower member 160*a* and lower end 172 of upper member 170*a* are coupled together via a fitting 158*a*, such as a forty-five degree bend fitting. Upper end 164 of lower member 160*b* and lower end 172 of upper member 170*b* are also coupled together via a fitting 158*b*, such as a forty-five degree bend fitting. Upper end 176 of upper member 170*a* and upper end 176 of upper member 170*b* are coupled together via a fitting 158*c*, such as a ninety degree bend fitting. Fitting 158*c* is alternatively a forty-five degree bend fitting along with forty-five degree bend fittings 158*a* and 158*b*, such that upper members 170*a* and 170*b* have to be bent slightly to fit into the three fittings. The slight bending of members 170*a* and 170*b* places the entire "U" or "V" shaped structure under tension when bolted down, helping to form a robust overall ball holding assembly.

Fittings 158*a* to 158*c* can be connected to their respective members via a suitable structure and method, such as via thread, permanent weld or adhesive, compression, e.g., via a ferrule/nut fit, or any combination thereof. In one alternative embodiment, three straight members and two ninety degree bend fittings are used. In another alternative embodiment, two straight members, one bendable member and two fittings are used. In this second alternative embodiment, the two fittings could be straight or forty-five degree bend fittings. Or, the alternative bendable member could be directly coupled to the upper ends 164 of the straight members using any of the structure and functionality described above for mounting members 60*a* and 60*b* and bending rod 70 of ball holding assembly 50.

Ball holding assembly 150 is further supported by struts 166. In the illustrated embodiment, each lower member 160*a* and 160*b* is supported by two struts 166, one lean-resisting strut 166 (extending along mat side 12*a* or 12*b*) to support the leaning of ball holding assembly 150 so as to hold baseball 100 out over home plate 30, and one impact-resisting strut 166 (extending along mat side 12*c*) to prevent ball holding assembly 150 from moving after baseball 100 (or other type) has been struck. It may be found that only the lean-resisting struts 166 are needed for members 160*a* and 160*b*, for example if the upside down "U" or "V" shape is sturdy and rigid enough without impact-resisting struts 166. Or, one impact strut 166 may support either member 160*a* or 160*b* in combination with two lean-resisting struts 166.

In the embodiment illustrated in FIG. 8, the lean-resisting struts 166 and the impact-resisting struts 166 each extend at roughly forty-five degrees from mat 12 and reach members 160*a* and 160*b* about halfway between lower end 162 and upper end 164. Struts 166 could alternatively extend at a different angle from mat 12 and at different angles relative to each other. For example, the lean-resisting struts 166 could extend at an angle of about sixty degrees from mat 12 and reach higher points along members 160*a* and 160*b*, closer to ends 164, while the impact-resisting struts 166 extend as shown at approximately forty-five degrees from mat 12.

In one embodiment, the lean-resisting struts 166 extend at least substantially parallel to mat sides 12*a* and 12*b*, while the impact-resisting struts 166 extend at least substantially parallel to mat side 12*c*. Thus, the lower ends 162 of lean-resisting struts 166 will meet with mounting holes (not viewable in FIG. 8) in mat 12 that are spaced inwardly from mat sides 12*a* and 12*b* at least substantially the same distance as are the mounting holes (not viewable in FIG. 8) in mat 12 that meet with the lower ends 162 of members 160*a* and 160*b*. However, the lower ends 162 of impact-resisting struts 166 will meet with mounting holes (not viewable in FIG. 8) in mat 12 that are spaced inwardly from mat side 12*c* a distance that is further than the distance in from mat side 12*c* that the mounting holes (not viewable in FIG. 8) in mat 12 that meet with the lower ends 162 of members 160*a* and 160*b* are spaced. Keeping the impact-resisting struts 166 at least substantially parallel to mat side 12*c* will help to maximize, at least on average, the resistance provided by the struts against forces applied by the user.

As illustrated in FIG. 8, mounting members 160*a* and 160*b* and struts 166 each extend to mat 12, creating a six point contact (alternatively, e.g., four or five point contact) between ball holding assembly 150 and mat 12. Each of the six points of contact is secured to the mat by a securing pin 152 that extends up through the mat and secures to, e.g., threads into, mounting members 160*a* and 160*b* and support struts 166. To this end, each of the lower ends 162 of the mounting members 160*a* and 160*b* and support struts 166 can have internal threads or internally threaded inserts, which receive threaded rod sections of the securing pins 152 through holes or apertures formed in mat 12.

Referring additionally to FIG. 9, securing pins 152 each include a head 154, such as a spherical ball, formed with or threaded, press-fitted, welded, or adhered onto a threaded rod 156. Pins 152 can be made of metal, plastic, rubber or any combination thereof. The heads or spherical balls 154 reside below the mat and allow threaded rods 136 to extend up through holes or apertures in mat 12 (not illustrated in FIG. 9 for sake of convenience) in any needed direction to engage threads or threaded inserts 168 located at lower ends 162 of mounting members 160*a* and 160*b* and support struts 166 and upper ends 164 of support struts 166. The holes or apertures in mat 12 (for systems 10 and 110) can have metal, plastic or rubber reinforcing rings that extend around the periphery of the holes to prevent the mat from tearing or deforming.

The upper ends 164 of struts 166 can also be formed with internal threads or threaded inserts 168 that also receive threaded securing pins 152 to fasten the upper ends of the struts to members 160*a* and 160*b* of the upside down "U" or "V" shape while tilted or angled a desired amount. Mounting members 160*a* and 160*b* are accordingly provided with apertures (e.g., angled apertures, not viewable in FIG. 8) that align with the upper ends 164 of support struts 166. Here, securing pins 152 are inserted downwardly at an angle defined by the apertures through mounting members 160*a* and 160*b* and are secured, e.g., threaded, into threads or threaded inserts 168 located at the upper ends 164 of support struts 166. The resulting ball holding assembly 150 in the illustrated embodiment accordingly uses ten securing pins and forms a solid, stable structure that is secured, e.g., bolted to, mat 12 (eight pins if only one impact-resisting strut 166 is used, six pins if no impact-resisting struts 166 are used).

The ends 162 and 164 of members 160*a* and 160*b* and struts 166 can be angled or chamfered at the appropriate angle to more squarely abut mat 12 (for both members 160*a* and 160*b* and struts 166) or mounting members 160*a* and 160*b* (for struts 166 only) to promote a robust assembly. In one embodiment, pins 152 are moveably tethered to their respective members 160*a* and 160*b* and struts to prevent pin misplacement. While threading pins 152 into members 160*a* and 160*b* and struts 166 is one possible solution, pins 152 could alternatively be press-fitted into the members and struts or be secured by removable, e.g., tethered, locking pins.

A ball holding strap or cord 186 is provided again with ball holding assembly 150. Strap or cord 186 can be untightened and/or unspooled from an upper member, such as upper member 170*a* as illustrated in FIG. 8, to raise or lower baseball 100. Strap or cord 186 is slid and fastened along upper member 170*a* via hook and pile ties 178 in the illustrated embodiment to allow baseball 100 (or other type of ball) to hang down towards home plate 30 at a desired distance. Ball 100 can again have a hole or bore through which strap or cord 186 is extended and knotted at its end via a knot 188 to hold the ball. Knot 188 can be glued or banded (e.g., via metal, plastic or rubber band(s)), so that it cannot come inadvertently undone. Fitting 158*c* is provided with a pair of bores or holes 159 that allow strap or cord 186 to enter fitting 158*c* from upper member 170*a* and exit fitting 158*c* downwardly towards home plate 130.

Ball holding assembly 150, like ball holding assembly 50, can be pulled apart and rolled up readily within mat 12. Assembly 150 breaks down essentially into straight tubes, a cord, a ball and hook and pile pieces that remain stuck to mat 12, all of which can be rolled up into the mat for ready transport.

Other Items

The following additional items may be provided with any system described herein, such as system 10, 110, 310, 410 or 510. Referring now to FIG. 10, in one embodiment, systems 10 and 110 are provided with a force sensor 90, which sends a signal out over signal wire 92 to a readout 94. Force sensor 90 may be of any suitable type, such as a strain gauge or load cell, which outputs a signal indicative of the force applied by the user to baseball 100. Force sensor 90 is placed between sections of strap or cord 86 or 186, and can operate to further dampen the response to the impact placed upon ball 100. The output signal is carried along wire 92 and causes readout 94 to display a number or graphic that provides a relative idea to the user of how much force has been transferred by the user to ball 100. While not illustrated, a power supply, such as a battery operated direct current ("DC") power supply, an alternating current ("AC") power supply, or a rechargeable DC powered supply, is provided, e.g., housed with force sensor 90 or readout 94, to power both force sensor 90 and readout 94.

A numeric readout or scale can be set, e.g., zero to one-hundred, that encompasses all reasonable forces that can be applied by any user of any age or skill via the particular swing and utensil (e.g., bat for baseball, club for golf, racket for golf) used for the sport. Readout 94 can have a three-setting switch, for example, which is set for baseball, golf or tennis. In this manner, for any of the sports, the player or trainer can judge a swing force for a particular age. A young player can also see the gradual increase in force as the player ages.

Readout 94 can alternatively display the force applied graphically. For example, readout 94 can be a bar chart for which a percentage of bars, e.g., left to right or bottom to top, are illuminated based upon the amount of force applied. Readout 94 can alternatively be a pie chart, a percentage which is illuminated based upon the amount of force applied. Or, sequentially complimentary phrases, such as "try again", "nice hit", and "smashed!" could be displayed. In an embodiment, force sensor 90, associated wiring, power supply, electronics, and readout 94 are provided in a single housing, e.g., located between sections of strap or cord 86 or 186. If readout 94 is separate, it can be located along the "U" or "V" shaped structure at a suitable point.

In an embodiment, the electronics are programmed and/or configured to sense a local maximum strain or stress and assign the output of readout 94 to the measured local maximum. That is, when ball 100 is stuck, the strain or stress will increase sharply to a maximum and then decrease sharply to zero. It is the maximum that counts, and which should be indicated to the player and/or coach. In the illustrated example, upon hitting ball 100, the stress or strain rises sharply from a zero readout level to a 44.7 readout level, and then tapers back towards zero. The electronics are configured to capture the maximum stress or strain, e.g., deflection of a beam or expansion of a spring, assign a readout to the maximum and stress or strain, e.g., 44.7, and display the assigned readout for a predetermined duration or until a new maximum is sensed, leading to an updated display.

Figure 11:
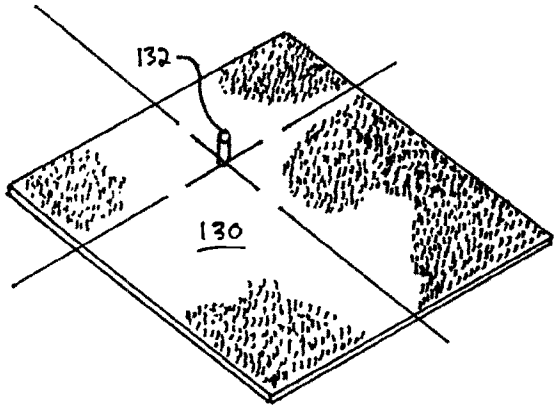
FIG. 11 is a is a top-front-left side perspective view of one embodiment of a golf tee and turf section for use with golf swing practice, and which can be used with multiple ones of the sports practicing system embodiments discussed herein.

Referring now to FIG. 11, in one embodiment, systems 10 and 110 are provided with a golf practice section or patch 130 that is used for golf practice in place of home plate 30. Section or patch 130 can be made of any suitable type of artificial or synthetic turf, such as any one or more of a short, medium or rough pile height polyurethane or polyethylene artificial or synthetic turf. The artificial or synthetic turf can be the same or different as that used for foot placement markers 20*a* to 20*d*. Section or patch 130 includes underside hook or pile material placed on its entire area, or on sections or strips of its underside area. Section or patch 130 removably attaches to pile or hook material area 18 of mat 12 in the manner described above for home plate 30.

Golf practice section or patch 130 includes a tee 132 in one embodiment that allows the golfer to practice tee shots. Tee 132 can be configured, e.g., rubberized, to fold down against section or patch 130 so that mat 12 can be rolled up for transport. In the illustrated embodiment, tee 132 is positioned off-center on mat 132 so that the golfer can alternatively practice fairway and/or rough shots.

Figure 12:
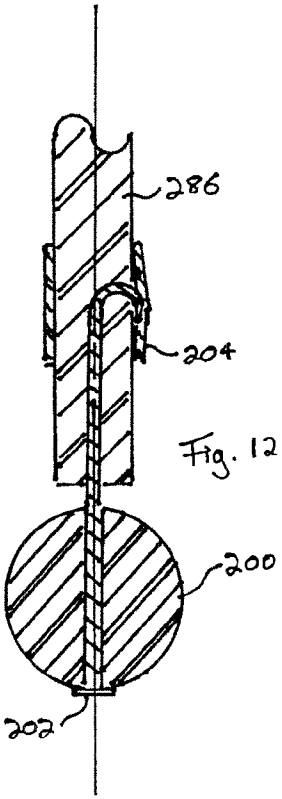
FIG. 12 is a front elevation view of one embodiment for securing a golf ball to the end of a bungee cord or other type of strap or hanging member.

A tennis ball is supported by strap or cord 86 or 186 in the same manner as described above for baseball 100 in one embodiment. Referring now to FIG. 12, in one embodiment, systems 10 and 110 are provided with a golf ball 200 that is modified as illustrated to hang from strap or cord 286. A hole is drilled through or formed with golf ball 200 as is done with baseball 100 (and tennis ball). Here, a nail or pin 202 is inserted up though the golf ball hole. A head of the nail or pin 202 comes to rest abutting against golf ball 200. The nail is extended further up into the end of strap or cord 286 a distance sufficient to extend past any frayed fibers or sections at the end of strap or cord 286. The top of nail or pin 202 is bent into a one-hundred eighty degree "U" shape. The sharp, distal end of the "U" is pierced through the outer surface of strap or cord 286, exposing the sharp, distal end of nail or pin 202. A further securing and protective band or wrap 204, e.g., of shrink wrap, is tightly secured, e.g., press-fit and/or adhered, about strap or cord 286. The sharp end of nail or pin 202 is thereby covered and prevented from harming the user.

The lower end of strap or cord 286 may abut the top of golf ball 200 or be spaced apart from the top of the golf ball as illustrated in FIG. 12. The attachment of golf ball 200 to strap or cord 286 does not depend upon the tightness of band or wrap 204, which could loosen. Nail or pin 202 has to rip all the way through the end of strap or cord 286 to come loose from the strap or cord, which is unlikely. Band or wrap 204 can also be sized such that it is virtually impossible for the sharp end of nail or pin 202 to become exposed.

Third Primary Embodiment

Figure 13:
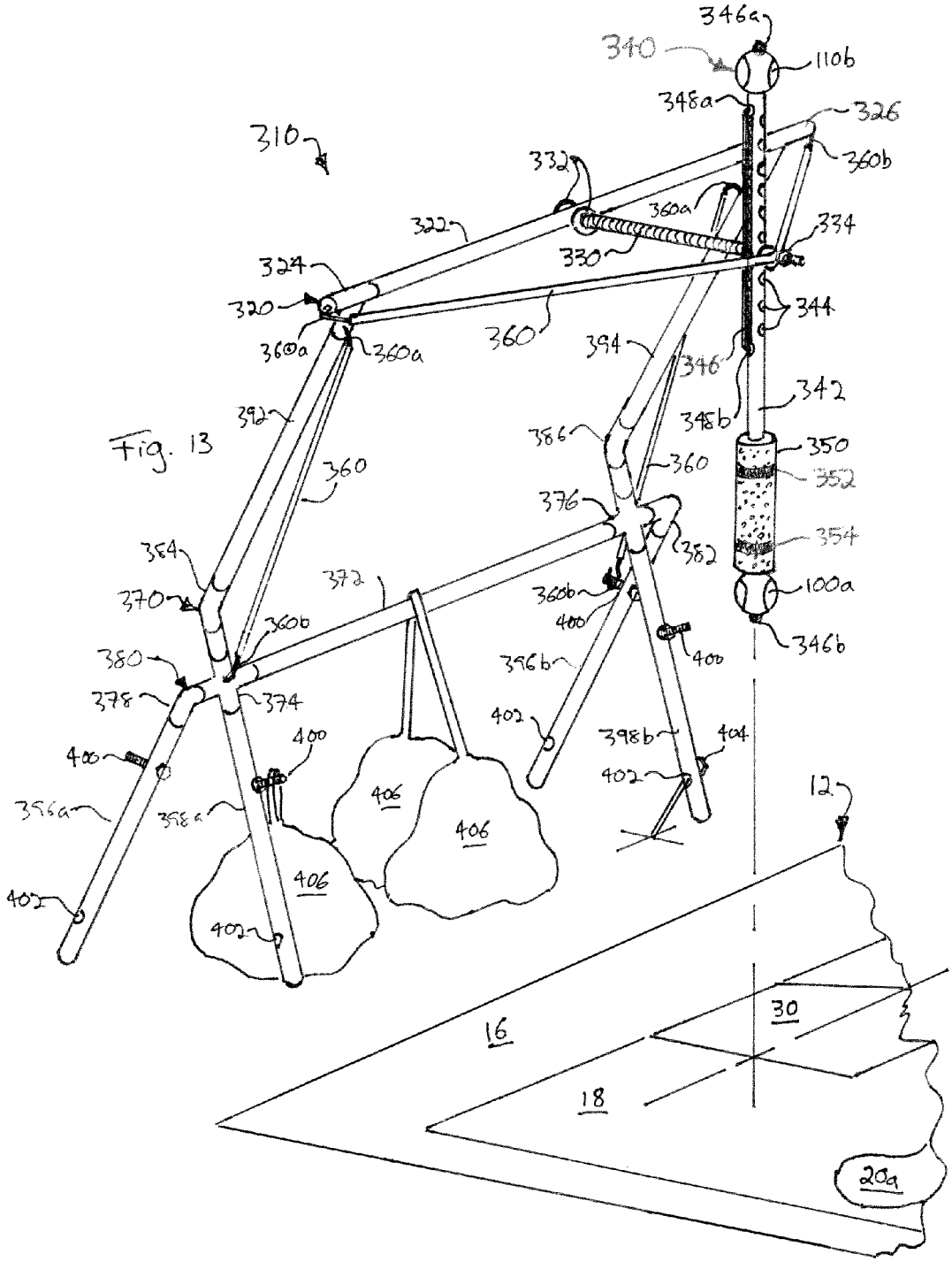
FIG. 13 is a top-front-left side perspective view of a further embodiment of a sports practicing system of the present disclosure.
Figure 14:
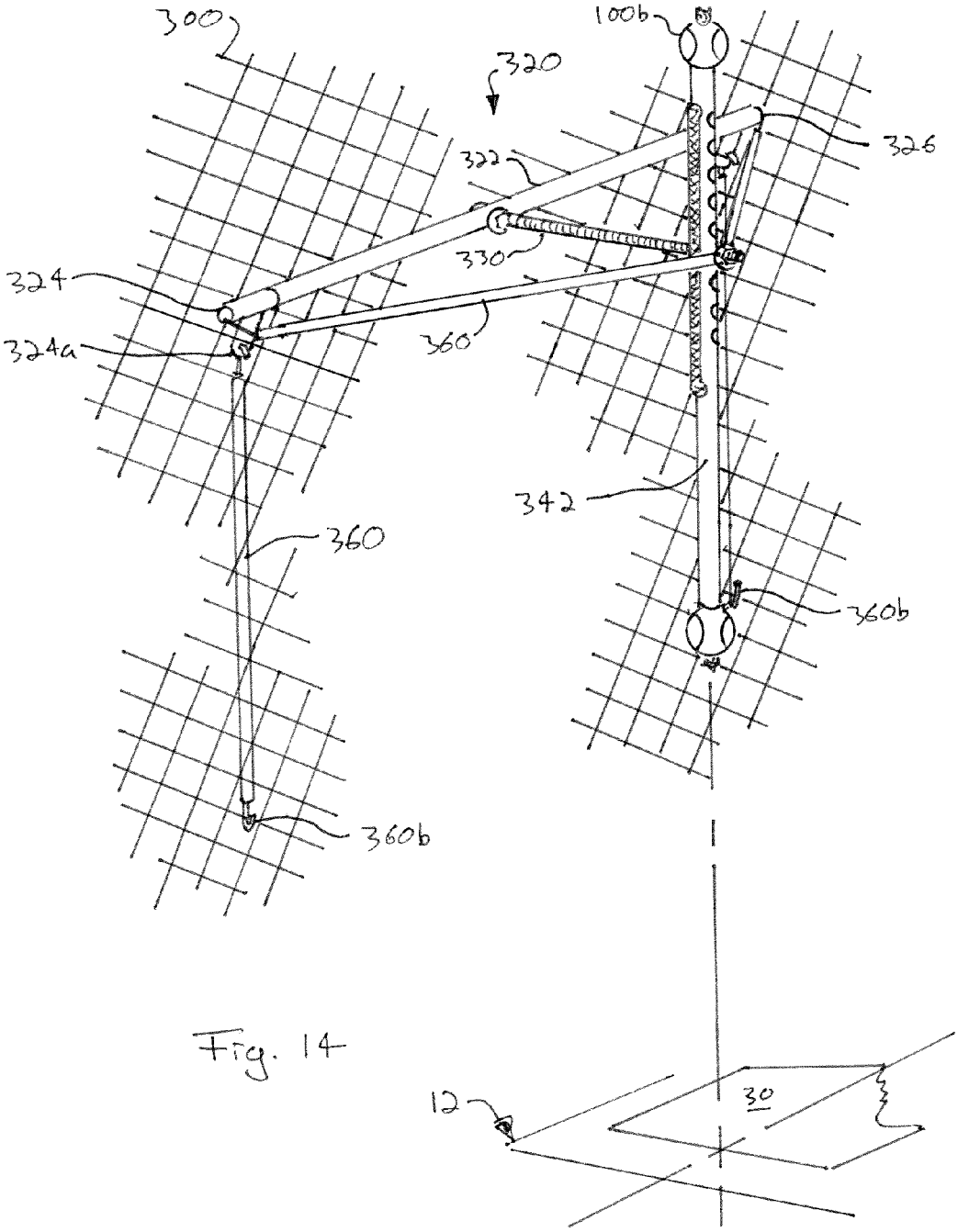
FIG. 14 is a top-front-left side perspective view of a ball holding portion of the sports practicing system of FIG. 13 used offsight away from a remainder of the system of FIG. 13.

Referring now to FIGS. 13 and 14, a further primary embodiment of a sports practicing system and associated method of the present disclosure is illustrated by system 310. System 310 is illustrated in FIGS. 13 and 14 for the sport of baseball. Just as with systems 10 and 110 however, system 310 is not limited to baseball and may be used for other sports, such as golf or tennis, for example.

System 310 is similar to the above systems 10 and 110 in certain respects. System 310, like systems 10 and 110 can include a mat 12, having a player side 14 and an equipment or ball positioning side 16. Player side 14 of mat 12 includes a pile or hook material area 18. Pile or hook material area 18 receives a home plate 30 and foot placement markers 20*a* to 20*d*, which are each moveably attachable to area 18 for desired positioning relative to ball or baseball 100*a*. Any and all embodiments, materials and alternatives discussed above for any of the commonly numbered structures found in systems 10 and 110 are wholly and equally applicable to and contained by system 310 and its associated methodology. In particular, any of the structural members of system 310 can be metal, e.g., steel, stainless steel or aluminum, or plastic, e.g., hard polyvinyl chloride ("PVC") tubing or pipe.

System 310 includes an upper subassembly 320 and a base or lower subassembly 370. Upper subassembly 320 includes an upper member 322 connected, e.g., adhered, threaded or compression fitted at each end to a tee 324 and 326. Upper member 322 at its middle includes or defines a hole (not viewable in FIG. 13) through which a threaded rod or pivot 330 is fitted. Threaded rod 330 can for example be a ⅜ inch (9.5 mm) or ½ inch (12.7 mm) diameter rod 330, standard thread pitch, steel, e.g., hardened or galvanized steel, or stainless steel. Rod 330 is secured to upper member 322 via hardware 332, such as, metal flat washers, lock washers, nuts and/or nylon-insert locking nuts.

The distal end of rod 330 is connected to a rotating baseball-hitting lever 340 via hardware 334. Hardware 334 in one embodiment includes a pair of nylon-insert locking nuts that can hold their position on rod 330. Inside each nylon-insert locking nut is a flat washer that abuts against lever arm 342. That is, there is a flat washer located between lever arm 342 and each nylon-insert locking nut. The nylon-insert locking nuts are spaced apart on either side of lever arm 342 a distance that is tight enough to hold lever arm 342 upright through its entire range of motion. The distance is loose enough, however, to allow lever arm 342 to pivot back and forth about the distal end of threaded rod 330, between fastened hardware 334.

Lever arm 342 defines a plurality of aligned mounting holes 344 that are sized to fit over threaded rod or pivot 330 and allow the lever member to be set so that baseball 100*a* (or other type of ball) resides at a desired height relative to the ground or home plate 30. As illustrated, in one embodiment, baseball 100*a* is a first baseball. Baseball-hitting lever 340 also includes a second baseball 100*b* (or other similar ball to that of ball 100*a*). The purpose of second ball 100*b* is to counteract the weight of batted or hit ball 100*a*, to reduce the moment produced when batted or hit ball 100*a* swings via the lower arm of lever member 342 about rod 330. To that end, in one embodiment second ball 100*b* is selected to weigh as much or more than ball 100*a*.

Balls 100*a* and 100*b* are each drilled to have a through hole as has been shown and described above. A stretchable cord 346, such as a bungee type cord, is attached at each end to one of balls 100*a* and 100*b* and is stretched taught, e.g., as taught as possible between balls 100*a* and 100*b*. In the illustrated embodiment, lever member 342 is of a smaller diameter, e.g., ½ inch schedule 40 or schedule 80 pipe, e.g., PVC pipe. In such a case, cord 346 may not fit within lever member 342 and be able to fit around threaded rod 330. Here, as illustrated, lever member 342 is provided with holes or apertures that allow cord 346 to extend to the outside of lever arm 342 so as to bypass each of the potential mounting holes 344 that may by user choice be mounted to threaded rod or pivot 330.

Cord 346 at its upper end is knotted at knot 346*a*, which in an embodiment is covered with an adhesive or epoxy, such as one marketed under the tradename Locktite™, or which can be or include acrylic, anaerobic, cyanoacrylate, silicone, hot melt, silicone and/or be cured via a ultraviolet ("UV") light technology. Likewise, cord 346 at its lower end is knotted at knot 346*b*, which in an embodiment is again covered with an adhesive or epoxy. The cured adhesive or epoxy prevents knots 346*a* and 346*b* from coming free or becoming unknotted. Cord 346 holds balls 100*a* and 100*b* tightly together but allows ball 100*a* to flex a little relative to lever member 342, reducing shock on the overall system 310 from ball 100*a* being hit or batted. To that end, padding 350, such as foam padding, can be provided at the bottom of lever member 342 to absorb the shock from an instrument, e.g., a bat, that strikes too high and hits member 342 (partially or completely) instead of ball 100*a*. Padding 350 can be adhered to the bottom of lever arm 342 or be releasably secured to lever arm 342 via fastening strips 352 and 354, which can be hook and pile strips, for example.

A flexible, stretchable, lever return strap or band 360, such as a tough rubber, e.g., a ½ inch (12.7 mm) wide by about 3/16 inch (4.8 mm) thick strap or band is provided with a hole in its middle. The hole is sized to fit, e.g., snuggly, over threaded rod or pivot 330, on the outside of the distal nylon-insert locking nut of hardware 334. A final distal nut holding elastic strap 360 to the locking nut of hardware 334 may or may not be provided. Strap is stretched to the left and connects via a hook 360*a*, e.g., a metal hook, to tee 324. Strap is stretched to the right and connects via a hook 360*b*, e.g., a metal hook, to tee 326. The stretched and connected strap as shown in FIG. 13 catches lever arm 342 when ball 100*a* is hit, moving the lever member in a first rotational direction, and returning lever member 342 towards the center upright position in the second, reverse direction. It should be appreciated that lever member 342 hits strap 360 in two places at any given time, on the lower side of strap 360 on one side of rod 330, and on the upper side of elastic strap 360 on the opposing side of rod 330.

When ball 100*a* is struck, lever arm 342 bounces back and forth against strap 360 until finally dampening out and coming to rest in the position shown in FIG. 13. It has been found that the lever member 342, strap 360 arrangement allows the player to swing at a moving target (with ball 100*a* coming back to the player) if the player so chooses. On the other hand, if the player wishes to swing at ball 100*a* while stationary, the lever member 342, strap 360 arrangement comes to rest fairly quickly, likely within the time it takes to reload a standard batting tee.

Upper subassembly 320 is removably attached to base or lower subassembly 370 via one or more additional elastic strap 360, which can be configured the same as strap 360 described above. Elastic straps 360 in one embodiment are each about 24 inches (61 cm) in length. Lower subassembly 370 includes a middle section 380, which for transport and storage can be fastened together via any combination of being adhered, threaded or compression fitted together. In the illustrated embodiment, middle section 380 includes lower horizontal member 372, which is fixed to crosses 374 and 376. Crosses 374 and 376 are in turn fixed to right angle elbows 378 and 382, respectively. Crosses 374 and 376 are additionally fixed to forty-five degree elbows 384 and 386, respectively.

Upper assembly 320 and middle section 380 are stored for transport in a bag (not illustrated) along with the remaining individual vertically angled upper struts 392 and 394 and lower vertical angled legs 396*a*, 396*b*, 398*a* and 398*b*. Vertically angled upper struts 392 and 394 and lower vertical angled legs 396*a*, 396*b*, 398*a* and 398*b* can each be angled from vertical an angle of anywhere at or between fifteen and seventy-five degrees. Vertically angled upper struts 392 and 394 and lower vertical angled legs 396*a*, 396*b*, 398*a* and 398*b* are held releasably fixed to subassembly 320 and middle section 380, as the case may be, by the additional straps 360 and their hook ends 360*a* and 360*b*. As illustrated, straps 360 can be hooked into holes formed in fittings, such as cross 374 and tee 324, or into holes formed in the members, such as strut 394 or around pegs 400 mounted to the legs. Straps 360 can be provided on the frontside and/or backside of system 310 as is illustrated in FIG. 13. There may be for example two or four additional straps 360 (besides ball return strap) as necessary to hold system 310 releasably together.

When it is desired to move system 310, straps 360 are removed and the system is broken down into subassembly 320, middle section 380, struts 392 and 394, and legs 396*a*, 396*b*, 398*a* and 398*b*. Those pieces may be placed in a bag or container along with mat 12 et al. for transport to a new location. When used outside, system 310 allows for spikes 404, e.g., metal spikes, to be inserted through holes 402 in legs 396*a*, 396*b*, 398*a* and 398*b* and staked into the ground to hold system 310 in place while ball 100*a* is struck. When used inside, system 310 allows for sandbags 406 to hang from pegs 400 and/or lower horizontal member 372 as needed to hold system 310 in place while ball 100*a* is struck.

Referring now to FIG. 14, it is expressly contemplated to size upper subassembly 320 and in particular the length of upper horizontal member 322 so that the free vertical legs 324*a* and 326*a* of tees 324 and 326, respectively, can fit through links of a chain fence 300 commonly found at baseball parks and fields, tennis courts and other sporting venues. Here, fence or external vertical support 300 provides the support to upper subassembly 320 that lower subassembly 370 did in FIG. 13. Here however, only upper subassembly 320 need be transported to the venue. It is expressly contemplated to use the arrangement of subassembly 320 at an actual baseball game for a batter on deck, or nearing a time at the plate, to warm-up, honing hand-eye coordination by striking moving baseball 100*a*.

Once free vertical legs 324*a* and 326*a* are inserted through holes in fence 300, straps 360 are stretched on the opposing side of the fence or vertical support 300 from subassembly 320 and mat 12 et al. Lower hook 360*b* of each strap 360 is hooked to a link of fence 300. Subassembly 320 is thereby secured at four points to fence or external vertical support 300 until it is time to remove subassembly for transport home, which is easily done. As illustrated, the arrangement of subassembly 320 with fence 300 may be used with mat 12 et al.

Fourth Primary Embodiment

Figure 15:
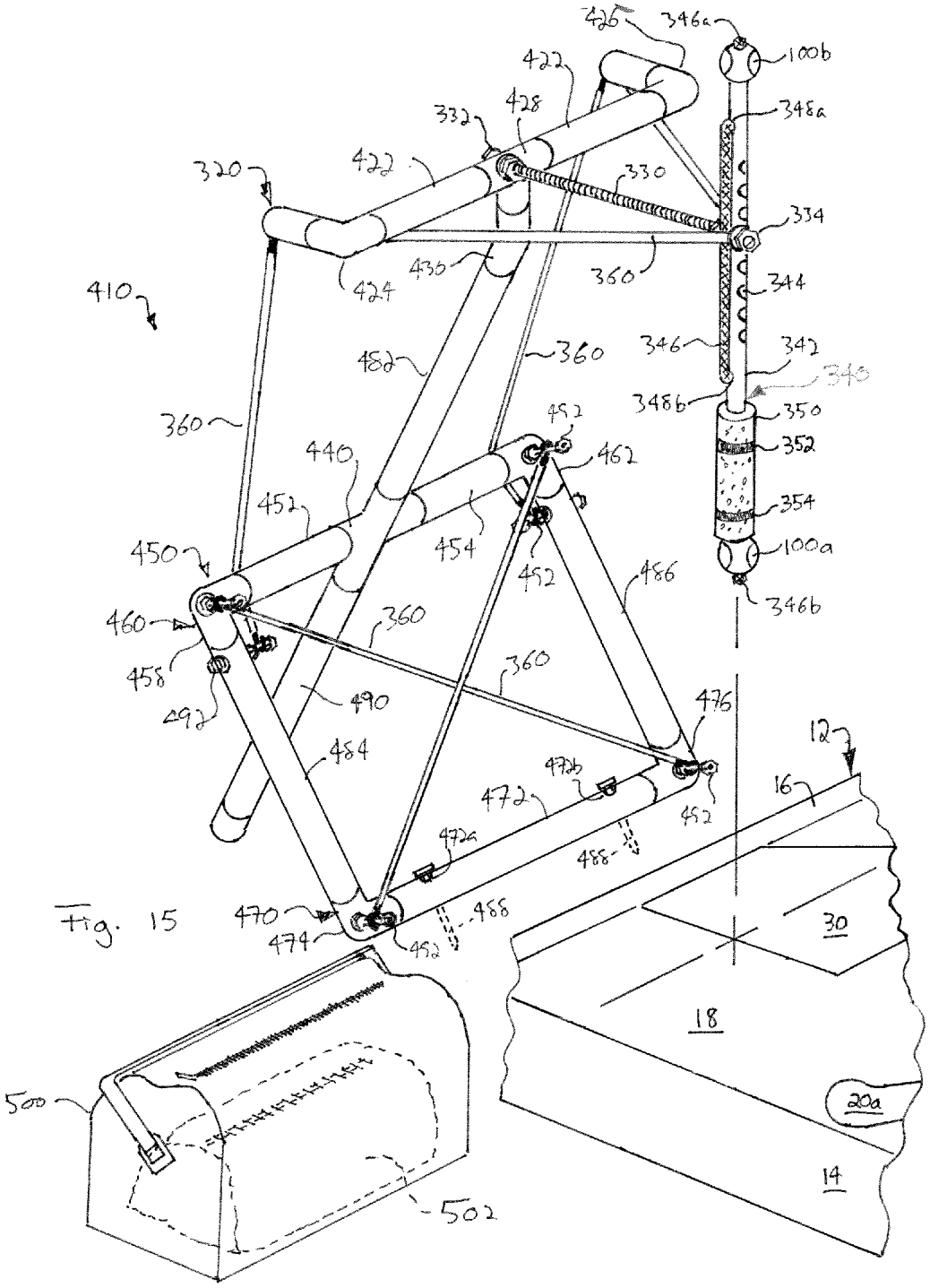
FIG. 15 is a top-front-left side perspective view of yet another embodiment of a sports practicing system of the present disclosure.
Figure 16:
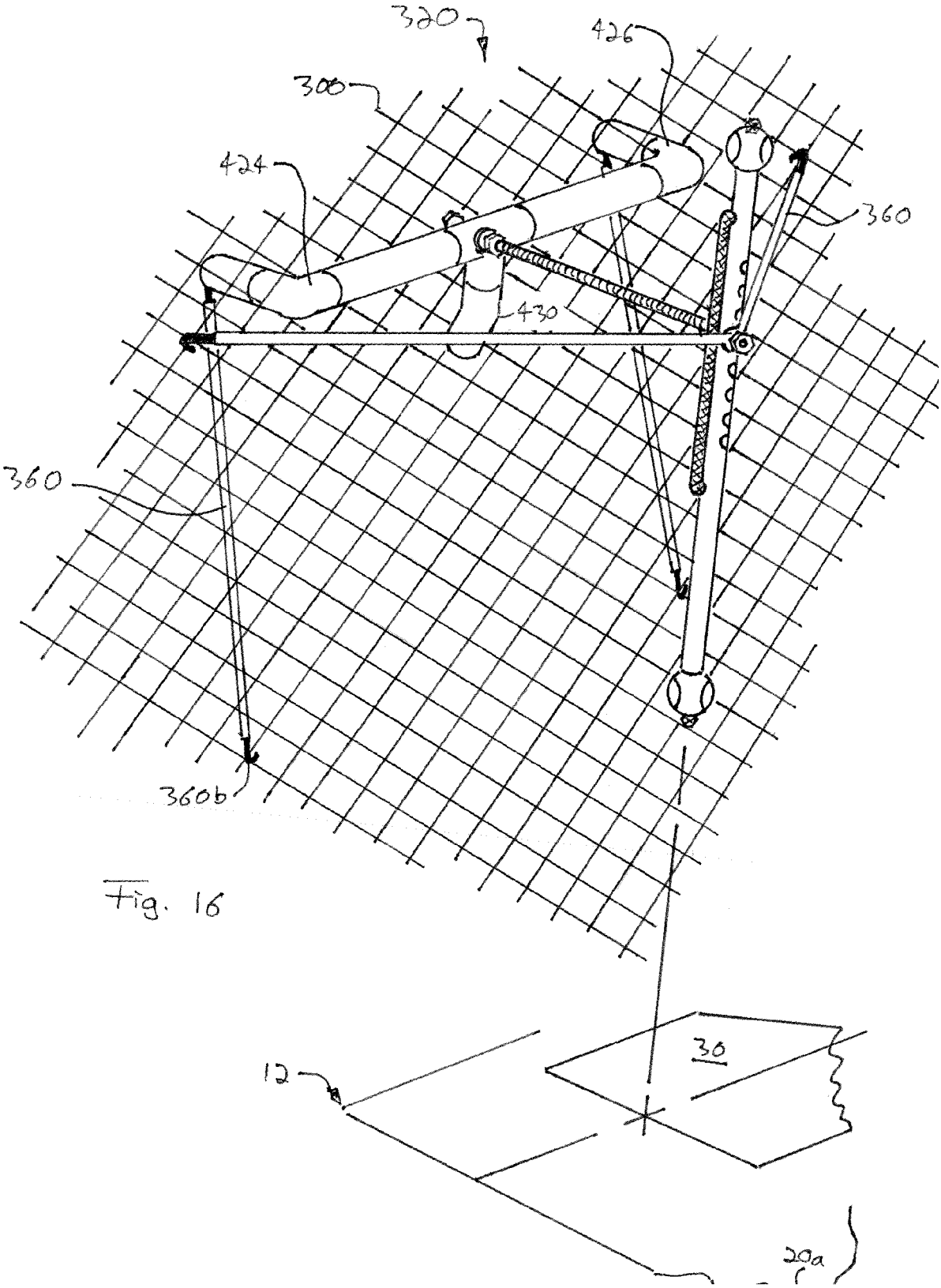
FIG. 16 is a top-front-left side perspective view of a ball holding portion of the sports practicing system of FIG. 15 used offsight away from a remainder of the system of FIG. 15.

Referring now to FIGS. 15 and 16, yet another primary embodiment of a sports practicing system and associated method of the present disclosure is illustrated by system 410. System 410 is illustrated in FIGS. 15 and 16 for the sport of baseball. Just as with systems 10, 110 and 310, however, system 410 is not limited to baseball and may be used for other sports, such as golf or tennis, for example.

System 410 is similar to system 310 and includes subassembly 320, as illustrated including each and every structural and functional feature and alternative described above for system 310. System 410, like systems 10, 110 and 310 can include a mat 12, having a player side 14 and an equipment or ball positioning side 16. Player side 14 of mat 12 includes a pile or hook material area 18. Pile or hook material area 18 receives a home plate 30 and foot placement markers 20*a* to 20*d*, which are each moveably attachable to area 18 for desired positioning relative to ball or baseball 100*a*. Any and all embodiments, materials and alternatives discussed above for any of the commonly numbered structures found in systems 10, 110 and 310 are wholly and equally applicable to and contained by system 410 and its associated methodology. In particular, any of the structural members of system 410 can be metal, e.g., steel, stainless steel or aluminum, or plastic, e.g., hard polyvinyl chloride ("PVC") tubing or pipe.

Subassembly 320 includes an alternative upper member 422, which includes a central tee 428 and outer elbows 424 and 426 (instead of just the outer tees of system 310). The lower leg of central tee 428 connects directly or indirectly to a forty-five degree fitting 430. Lower subassembly 450 includes a fixed middle section 460, which has connected members 452, 454, right-angle elbows 458 and 462 connected to the outsides of members 452 and 454, respectively, and cross 440, connected to the outsides of members 452 and 454. The angle of cross 440 relative to straight vertical can again be anywhere from fifteen to seventy-five degrees. Members, elbows and cross are fixed together via adhesive, thread or compression in various embodiments. Lower subassembly 450 also includes a fixed lower section 470, which has connected member 472 and right-angle elbows 474 and 476. Member 472 and right-angle elbows 474 and 476 are fixed together via adhesive, thread or compression in various embodiments.

Upper angled vertical member 482 (angle set by cross 440) and lower angled vertical members 484 and 486 (angle again set by cross 440) are removably fixed within system 410 and come free for transport. Bracing member 490 fits removably into the final leg of cross 440 and braces middle section 460 against the ground. Thus for transport, system 410 breaks down into upper subassembly 320, middle section 460, lower section 470, angled vertical members 482, 484 and 486, and bracing member 490. The items along with straps 360 and mat 12 et al. fit within bag or container 500. Bag or container 500 also holds one or more sandbag 502, which is filled and removably placed upon lower member 472 for inside use. For outside use, holes 472*a* and 472*b* in lower member 472 allow spikes 488 to stake system 410 to earth.

Lower straps 360 are crisscrossed in the illustrated embodiment, their hook ends connected to pegs 492 fixed to elbows 458, 462, 474 and 462, holding base or lower subassembly 450 together removably. Although not illustrated, an additional strap 360 could be used to compress bracing member 490 to upper angled vertical member 482. In the illustrated embodiment, system 410 generally uses a larger diameter member, e.g., 1.5 inch pipe (schedule 40 or 80) for all but lever arm 342, which again can be ½ inch pipe (schedule 40 or 80). Upper straps 360 hold upper subassembly 320 to lower subassembly 370. Upper hooks of straps 360 hook around pegs 492 fixed to lower members through holes formed in elbows 424 and 426. Lower hooks of straps 360 hook around pegs 492 fixed to lower, angled vertical members 484 and 486.

FIG. 16 illustrates an alternative upper subassembly 320 connected to fence or external vertical support 300. The arrangement here is much like that of FIG. 14, including the use of mat 12 et al. Here however, forty-five degree fitting 430 provides extra stability against fence 300. Also, and the system 310 and 510 versions may do the same, the ends of ball-reflecting elastic strap 360 can be stretched and hooked to links of fence 300 instead of to outer fittings 424 and 426. Again, vertical straps 360 are located behind fence 300 and are hooked at their top ends to elbows 424 and 426 (or straight members connected to same). In FIG. 16, subassembly 320 has five point contact with fence 300.

Fifth Primary Embodiment

Figure 17:
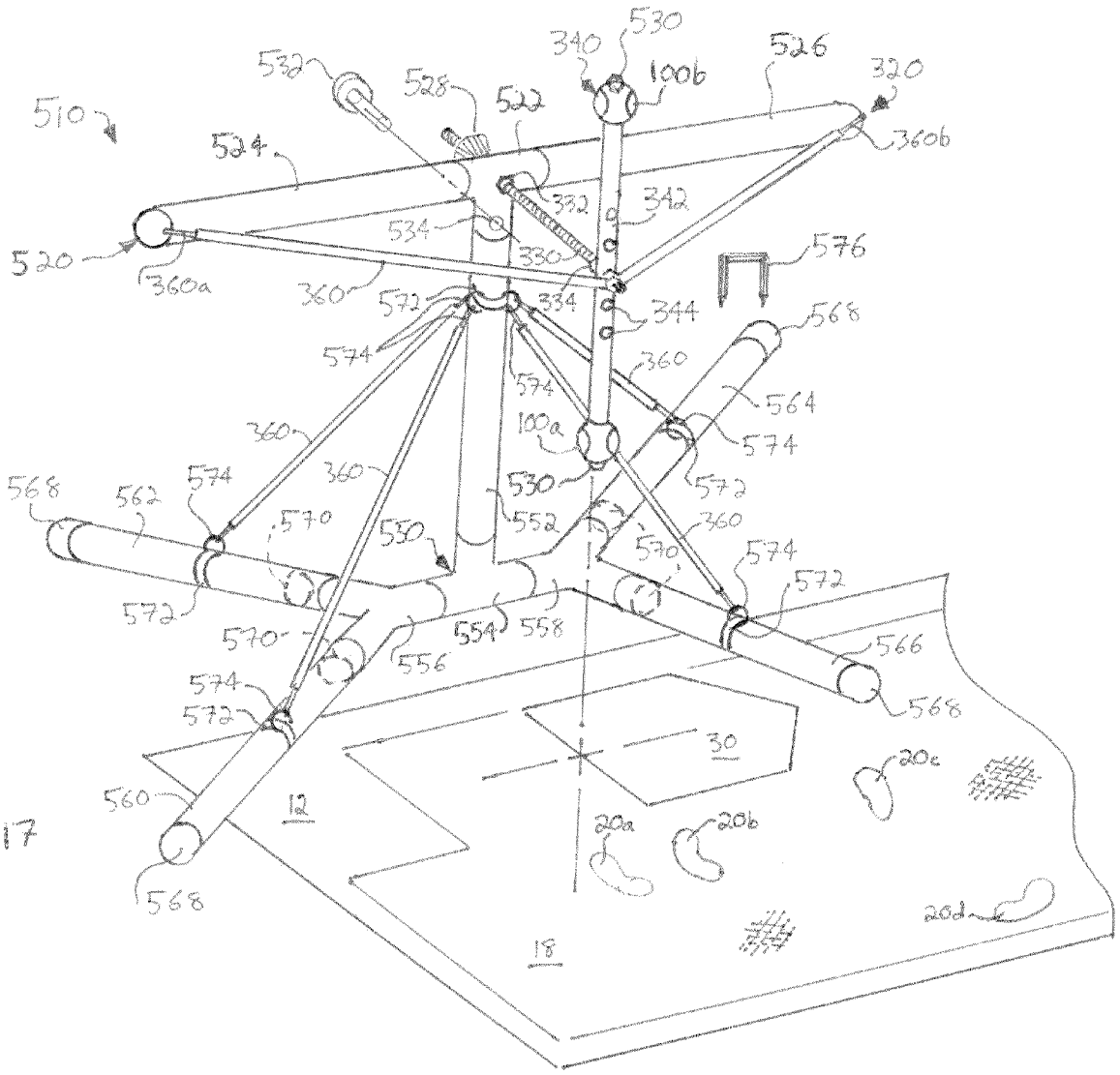
FIG. 17 is a top-front-left side perspective view of yet a further embodiment of a sports practicing system of the present disclosure.

Referring now to FIG. 17, yet a further primary embodiment of a sports practicing system and associated method of the present disclosure is illustrated by system 510. System 510 is illustrated in FIG. 17 for the sport of baseball. Just as with systems 10, 110, 310 and 410, however, system 510 is not limited to baseball and may be used for other sports, such as golf or tennis, for example.

System 510 is somewhat similar to systems 310 and 410 and includes upper subassembly 320, including each and every structural and functional feature and alternative described above for systems 310 and 410. System 510, like systems 10, 110, 310 and 410 can include a mat 12, having a player side 14 and an equipment or ball positioning side 16. Player side 14 of mat 12 includes a pile or hook material area 18. Pile or hook material area 18 receives a home plate 30 and foot placement markers 20*a* to 20*d*, which are each moveably attachable to area 18 for desired positioning relative to ball or baseball 100*a*. Any and all embodiments, materials and alternatives discussed above for any of the commonly numbered structures found in systems 10, 110, 310 and 410 are wholly and equally applicable to and contained by system 510 and its associated methodology. In particular, any of the structural members of system 510 can be metal, e.g., steel, stainless steel or aluminum, or plastic, e.g., hard polyvinyl chloride ("PVC") tubing or pipe.

Subassembly 320 includes an alternative upper member 520, which includes a central tee 522 fitted with, e.g., permanently attached to, outer members 524 and 526 (instead of the outer tees of system 310 or the central tee 428 and outer elbows 424 and 426 of system 410). Central tee 524 defines a hole (covered in FIG. 17), which receives a threaded rod or pivot 330, which includes all of the structure and alternatives discussed above. Rod 330 is secured to upper member 520 via hardware 332, such as, metal flat washers, lock washers, nuts and/or nylon-insert locking nuts. One embodiment for securing rod 330 to upper member 520 is illustrated and described in connection with FIG. 18 and includes a female threaded hand-actuated knob 528, which removably compresses upper member 520 against hardware 332. On the distal end of rod 330, elastic strap 360 in FIG. 18 compresses a collar against hardware 334 to hold baseball lever 340 pivotally in place. To this end, strap 360 includes a first hook 360*a* at one end that hooks to the outer end of pipe member 524 and a second hook 360*a* at the other end that hooks to the outer end of pipe member 526. The outer ends of pipe members 524 and 526 can include or define holes that accept first and second hooks 360*a* and 360*b*, respectively.

It is contemplated to size knob 528 to fit inside of and through one of the holes created by a chain-link fence or external vertical support 300 (FIGS. 14 and 16). Knob 528 and the bottom, vertical leg of central tee 522 form a right angle structure that sets and orients upper subassembly 320 against fence or external vertical support 300 when the upper subassembly is removed from base or lower subassembly 550 for mounting to fence 300. Here, knob 528 extends through fence 300. Straps 360 are used then to secure the outer ends of pipe members 524 and 526 by stretching and hooking to links of chain-link fence 300. In the chain-link fence 300 application of system 510, upper subassembly 320 can be located so that the user can strike either upper ball 100*b* or lower ball 100*a*. It is contemplated for the user to strike the upper ball 100*b* in the full assembled version of system 510 of FIG. 17, which is different than in FIGS. 13 and 15, in which it is contemplated for the user to strike lower ball 100*a*.

Lever member 342 of lever 340 defines a plurality of aligned mounting holes 344 that are sized to fit over threaded rod 330 and allow the lever member to be set so that (here upper) baseball 100*b* (or other type of ball) resides at a desired height relative to the ground or home plate 30. As before, baseball-hitting lever 340 includes two balls to counteract the weight of a batted or hit ball, to reduce the moment produced when the batted or hit ball swings via lever arm 342 about rod 330. To that end, in one embodiment balls 100*a* and 100*b* are selected to weigh the same.

Lever member 342 is in one embodiment a metal, e.g., steel, stainless steel, or aluminum pipe, e.g., a ½ inch, ¾ inch or one inch (or equivalent metric size) diameter schedule 10, 40 or 80 pipe that is female threaded on both ends. Balls 100*a* and 100*b* are each drilled to have a through hole as has been shown and described above. Bolts and washers 530, such as flat and lock washers extend through the holes in balls 100*a* and 100*b* and removably fasten the balls to the upper and lower ends of lever arm 342. Although not illustrated, padding such as padding 350 illustrated above at FIGS. 13 and 15 can be secured to one or both of the upper and lower ends of lever member 342 in any of the manners discussed herein. Bolting balls 100*a* and 100*b* as illustrated with system 510 may be done as well with systems 310 and 410. Likewise, the stretchy or bungee cord method of holding balls in systems 310 and 410 may be done alternatively with system 510.

The lower leg of central tee 522 of upper subassembly 320 connects removably to a vertical post 552 of base or lower subassembly 550. It is contemplated to provide multiple, swappable vertical posts 552 of different lengths for course, vertical ball striking position adjustment and allow holes 344 in lever member 342 to provide fine height adjustment. In an embodiment, vertical post 552 comes free from both upper tee 522 of upper subassembly 320 and a lower tee 554 of lower subassembly 550 for transport of system 510 (which can be done along with mat 12 et al. using bag or container 500 as described above). Because vertical post 552 remains with lower subassembly 550 when upper subassembly 320 is used with chain-link fence 300 (FIGS. 14 and 16), vertical post 552 is considered part of base or lower subassembly 550.

Lower tee 554 of lower subassembly 550 in one embodiment includes or is connected to a reducer (not illustrated), which reduces the diameter of tee 554 to a smaller diameter for vertical post 552. For example, tee 554 and the remainder of lower subassembly 550 can be three or four inch diameter schedule 10, 40 or 80, e.g., PVC, pipe, and wherein the vertical leg of tee 554 itself reduces to, or connects to a reducer that reduces to, two inch diameter schedule 10, 40 or 80, e.g., PVC, pipe. The larger diameter pipe of base or lower subassembly 550 allows for at least some of its members to be filled, e.g., with sand, to provide a heavy, weighted base.

Lower tee 554 is connected, e.g., permanently affixed, to a pair of "Y" connectors 556 and 558 in the illustrated embodiment, which allow for the bottom of lower subassembly 550 to spread out without impeding into the user's hitting path or covering plate 30. "Y" connectors 556 and 558 could alternatively be tees as long as the front base legs of base or lower subassembly 550 are short enough so as not to impede into the user's hitting path or cover plate 30.

"Y" connectors 556 and 558 in the illustrated embodiment are connected removably to base legs 560, 562, 564 and 566, respectively. Each of base legs 560, 562, 564 and 566 includes, e.g., is permanently or threadingly fixed to, a distal cap 568. Distal caps 568 along with internal proximal caps 570 provided with each base leg 560, 562, 564 and 566 encapsulate and hold a substance for weighting lower subassembly 550, such as sand or bone dry sand. The sand filled base of legs 560, 562, 564 and 566 provides a heavy, low center of gravity to overall system 510. Also, structuring system 510 such that upper ball 100*b* is hit allows system 510 to have a lower vertical profile than systems 310 and 410, making system 510 less top heavy and less prone to tipping.

The strong base or lower subassembly 550 also provides a sturdy foundation for tensioning and holding vertical post 552 and upper subassembly 320 in place while ball 100*b* is struck and vacillating back and forth, bouncing off of strap 360. Each leg 560, 562, 564 and 566 is fitted with an adjustable, e.g., steel or stainless steel, band or hose clamp 572, which each hold a loop or d-ring 574 tight against the leg. A fifth band or hose clamp 572 is provided along the top of vertical post 552 (as illustrated) or more preferably along the bottom of vertical leg of upper tee 552 (not illustrated to better show all the components of upper subassembly 320). The fifth band or hose clamp 572 holds four loop or d-rings 574 tight against vertical post 552. Four, e.g., tough rubber straps 360 are stretched and tensioned between the four loops or d-rings 574 held against upper tee 552 or vertical post 552 and the four individual loops or d-rings 574 held against respective legs 560, 562, 564 and 566.

One or more locking pin 532 may also be provided along with mating holes 534 in upper tee 522 and vertical post 552 to lock upper subassembly 320 to the post to prevent subassembly 320 from translating off of or twisting against post 552. A plurality of stakes 576 may also be provided for staking legs to 560, 562, 564 and 566 to outdoor ground if additional support is needed. One or more sandbag may alternatively or additionally be laid on one or more of legs 560, 562, 564 and 566. Legs 560, 562, 564 and 566 and/or caps 568 may further have frictional members to prevent system 510 from sliding during use.

To assemble system 510, it is contemplated to remove its components from a carrying container or bag 500. Next, weighted legs 560, 562, 564 and 566 are inserted into "Y" connectors 556 and 558, which are held together via lower tee 554. A solid, heavy, low center of gravity base is thus formed. Next, vertical post 552 is inserted into the vertical upwardly pointing leg of lower tee 554. Next, upper tee 522 with connected pipe members 524 and 526 forming upper member 520 is fitted onto the top of vertical post 552. Pin 532, if provided, can be inserted into mated holes 534, if provided, and locked via a nut or second hand-actuated knob 528 (not illustrated). Next, the four tensioning straps 360 are connected to (i) pull upper tee 522, upper member 520, and upper subassembly 320 against the top of vertical post 552 and (ii) pull the bottom of vertical post 552 into lower tee 554. Finally, threaded rod 300 and lever impinging strap 360 are connected releasably to upper subassembly 320. System 510 is generally deconstructed in the reverse order.

Figure 18:
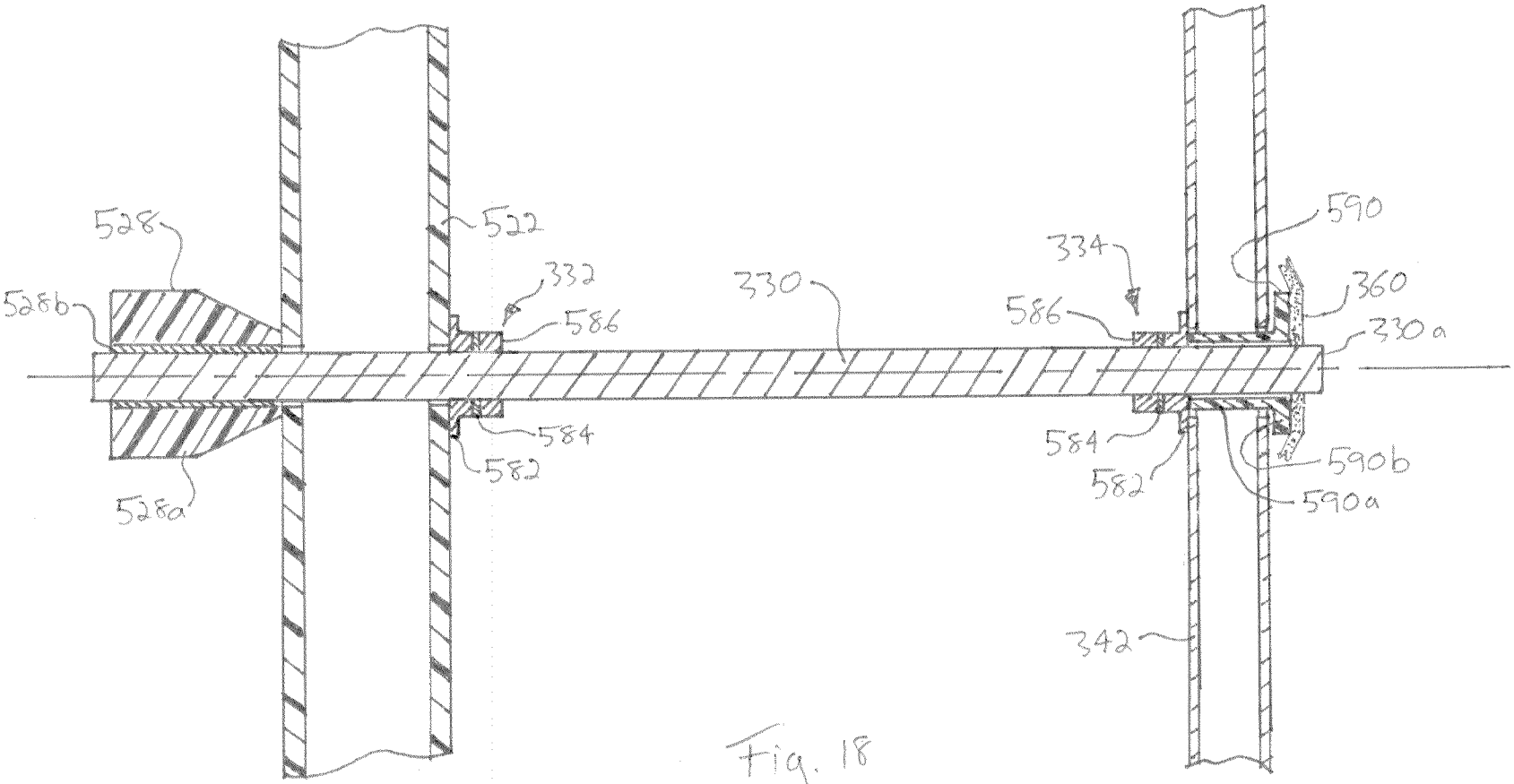
FIG. 18 is an elevation sectioned view of one embodiment for removably attaching the threaded rods of the embodiments of FIGS. 13 to 17 to the respective upper subassemblies and ball holding levers.

Referring now to FIG. 18, one embodiment for the threaded rod or pivot and associated hardware portion of upper subassembly 320 is illustrated. FIG. 18 illustrates threaded rod 330, upper tee 522, hand-actuated knob 528, hardware 332 and 334, and elastic strap 360, all discussed in connection with system 510 of FIG. 17. It should be appreciated however that the structure and operation discussed in connection with FIG. 18 can be used with any of systems 310, 410 and 510. Hardware 332 and 334 in the illustrated embodiment each include a washer nut 582, lock washer 584 and jam nut 586. When tightened together, washer nut 582, lock washer 584 and jam nut 586 form solid stops along threaded rod 330 and do not move along the rod unless loosened, as if they had been welded to the rod, which they can be in an alternative embodiment. Hand-actuated knob 528 includes a polymer, e.g., rubber or plastic, handle 528*a* and a metal, e.g., steel or stainless steel, threaded insert 528*b* that threads matingly to threaded rod 330. Threading hand-actuated knob 528 along rod 330 thus pulls hardware 332 towards knob 528 to releasably compress upper tee 522 between knob 528 and hardware 332 as illustrated in FIG. 18.

A collar 590 is provided that fits into the aligned mounting holes 344 of lever arm 342. Collar 590 can be metal, e.g., steel, stainless steel or aluminum, or plastic, such as teflon. Collar 590 includes a stem portion 590*a* and a flange or washer portion 590*b*. Stem portion 590*a* can slide over or thread onto threaded rod 330. The outer diameter of stem portion 590*a* and the diameters of mounting holes 344 are sized so that lever member 342 can rotate freely about collar 590. The length of stem portion 590*a* is set so that the distance between the inner surfaces of washer nut 582 and washer portion 590*b* of collar 590 is such that lever member 342 can rotate freely but not wobble about the outer diameter of stem portion 590*a* when stem portion 590*a* is compressed against fixed hardware 334.

It is contemplated to use the tensioning of elastic strap 360 (see FIG. 17) to compress stem portion 590*a* against fixed hardware 334. Thus the connection of hooks 360*a* and 360*b* to the distal ends of members 524 and 526 and the placement of strap 360 (via a hole in the strap) over the distal end 330*a* of rod 330 serves the additional purpose of holding the lever member 342 portion of upper subassembly 320 removably together. The diameter of washer portion 590*b* of collar 590 is sized to deflect strap 360 enough so that the strap does not contact lever member 342 when the lever member is in the vertical position of FIG. 17.

It should accordingly be appreciated that the structure of FIG. 18 allows threaded rod 330 to be attached to upper member 520, and lever member 342 to be pivotally attached to threaded rod 330 without requiring a separate tool. When disassembled, e.g., when initially packaged, collar 590 can be slipped over rod 330 and stored between hardware 334 and hand-actuated knob 528 when threaded onto rod 330. It should be appreciated that threaded rod 330 does not have to be threaded along its entire length and can instead be threaded only at its ends.

Additional Aspects of the Present Disclosure

Aspects of the subject matter described herein may be useful alone or in combination one or more other aspect described herein. Without limiting the foregoing description, in a first aspect of the present disclosure a sports practicing system includes a mat; a ball holding assembly secured to the mat, the ball holding assembly suspending a ball at a desired elevation above the mat to be struck by a user, the ball holding assembly constructed from members that can be disassembled and rolled up within the mat for transportation of the system; and at least one of a home plate and a golf practice section releasably securable to the mat, the at least one of the home plate and golf practice section thin and pliable enough to be rolled up within the mat for transportation of the system.

In accordance with a second aspect of the present disclosure, which may be used in combination with the first aspect, the sports practicing system includes at least one foot placement marker releasably securable to the mat.

In accordance with a third aspect of the present disclosure, which may be used in combination with any one or more aspect listed herein, the ball holding assembly includes at least one strut to suspend the ball at the desired elevation above the mat.

In accordance with a fourth aspect of the present disclosure, which may be used in combination with any one or more aspect listed herein, the ball holding assembly includes a strap or cord to suspend the ball at the desired elevation above the mat.

In accordance with a fifth aspect of the present disclosure, which may be used in combination with any one or more aspect listed herein, the ball holding assembly includes at least one strut to resist forces applied to the ball holding assembly when the ball is struck.

In accordance with a sixth aspect of the present disclosure, which may be used in combination with any one or more aspect listed herein, the ball is attached to a strap or cord that is attachably raised or lowered to place the ball at the desired elevation above the mat.

In accordance with a seventh aspect of the present disclosure, which may be used in combination with any one or more aspect listed herein, the sports practicing system includes a force sensor to gauge a force applied to the ball when struck.

In accordance with an eighth aspect of the present disclosure, which may be used in combination with any one or more aspect listed herein, a sports practicing system includes: a lever arm including an aperture; at least one ball secured to the lever arm; a pivot about which the lever arm rotates; an upper member to which the pivot is connected, the upper member including first and second ends; a base for placement on a ground, the base supporting the upper member; and an elastic strap stretched from the first end of the upper member to the second end of the upper member, an inner portion of the strap intersecting the pivot so the strap deflects the lever arm and the ball when the lever arm rotates about the pivot due to the ball being struck.

In accordance with a ninth aspect of the present disclosure, which may be used in combination with any one or more aspect listed herein, a kit for a sports practicing includes: a lever arm; at least one ball for securing to the lever arm; a pivot about which the lever arm rotates; an upper member to which the pivot is connected; structure for securing the pivot to the lever arm and upper member; a strap for deflecting the lever arm; and a plurality of members for forming a base for supporting the upper member. The kit can also include at least one additional strap for securing the base to the upper member. The kit can further include: (i) a mat positionable with respect to the upper member, pivot, lever arm and base, (ii) a plurality of foot markers removably attachable to the mat, (iii) a home plate, (iv) at least one sandbag, and (v) a bag for storing and transporting the kit.

In accordance with a tenth aspect of the present disclosure, which may be used in combination with any one or more aspect listed herein, a sports practicing method includes: enabling a ball to be pivoted about a pivot; counterweighting the ball on an opposing side of the pivot from the ball; and reversing a rotational direction of the ball after being struck to rotate back towards a user so that the ball can be re-struck. The method can further include reversing a rotational direction of the ball a plurality of times after being struck to reduce the momentum of the ball.

In accordance with an eleventh aspect of the present disclosure, any of the concepts, methodology and structure discussed and illustrated in connection with any one or more of FIGS. 1 to 18 may be used with any one or more aspect listed herein.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A sports practicing system comprising:

a lever arm;

at least one ball secured to the lever arm;

a pivot about which the lever arm rotates; and an elastic strap secured at each of its ends and defining an aperture that engages the lever arm at a middle portion of the strap such that when the ball is hit from an initial position, the lever arm rotates in a first rotational direction about the pivot, stretching the elastic strap, which thereafter unstretches to return the ball in a second rotational direction towards the initial position.

2. The sports practicing system of claim 1, which includes a mat; and a plurality of foot markers removably attachable to the mat, the plurality of foot markers so positioned and arranged relative to the lever arm, ball and pivot to indicate a desired foot placement before and after a user's swing at the ball.

3. The sports practicing system of claim 2, wherein the mat includes an area of hook or pile material and the foot markers include the other of pile or hook material.

4. The sports practicing system of claim 2, wherein the mat is sized to fit beneath the lever arm, ball, pivot and foot markers.

5. The sports practicing system of claim 2, wherein the foot markers are flexible so that they can be rolled up with the mat.

6. The sports practicing system of claim 2, wherein the foot markers are configured to provide tactile feedback to the user.

7. The sports practicing system of claim 2, wherein the foot markers are made of artificial turf.

8. The sports practicing system of claim 2, which includes at least three foot markers, one for the user's back foot and two for the user's front foot.

9. The sports practicing system of claim 1, wherein the lever arm includes first and second ends, the ball a first ball secured to the first lever arm end, and which includes a second ball secured to the second lever arm end.

10. The sports practicing system of claim 9, which includes an aperture through each of the first and second balls, and which includes first and second bolts or a stretchable cord extending through the apertures to secure the balls to the first and second ends of the lever arm.

11. The sports practicing system of claim 1, wherein at least a portion of the pivot is threaded for securing to the lever arm.

12. The sports practicing system of claim 1, wherein the pivot, lever arm and ball are configured for connection and operation with an external vertical support.

13. The sports practicing system of claim 1, wherein the lever arm includes a plurality of apertures for receiving the pivot and for ball height striking adjustment.

14. A sports practicing system comprising:

a structure presenting a ball in such a manner that a user may swing at and hit the ball, the structure including a lever arm, the ball residing at a distal end of the lever arm, and an elastic strap secured at each of its ends and defining an aperture that engages the lever arm at a middle portion of the strap such that when the ball is hit from an initial position, the lever arm rotates in a first rotational direction, stretching the elastic strap, which thereafter unstretches to return the ball in a second rotational direction towards the initial position.

15. The sports practicing system of claim 14, which includes a mat; and a plurality of foot markers removably attachable to the mat, the plurality of foot markers so positioned and arranged relative to the structure to indicate a desired foot placement before and after the user's swing at the ball.

16. A kit for a sports practicing system, the kit comprising:

a lever arm;

at least one ball secured to the lever arm;

a pivot about which the lever arm rotates; an elastic strap secured at each of its ends and defining an aperture that engages the lever arm at a middle portion of the straps such that when the ball is hit from an initial position, the lever arm rotates in a first rotational direction about the pivot, stretching the elastic strap, which thereafter unstretches to return the ball in a second rotational direction towards the initial position; a plurality of members for forming a base for supporting the pivot, the lever arm and the strap.

17. The kit of claim 16, which includes at least one additional strap for securing the base to the lever arm.

18. The kit of claim 16, which includes at least one additional item selected from the group consisting of: (i) a mat positionable with respect to the pivot, lever arm and base, (ii) a plurality of foot markers removably attachable to the mat, (iii) a home plate, (iv) at least one sandbag, and (v) a bag for storing and transporting the kit.

19. A sports practicing method using the sports practicing system of claim 1 or claim 14, the sports practicing method comprising utilizing the device of either claim 1 or claim 14: enabling a ball to be pivoted about a pivot; counterweighting the ball on an opposing side of the pivot from the ball; and reversing a rotational direction of the ball after being struck to rotate back towards a user so that the ball can be re-struck.

* * * * *